US008985794B1

(12) United States Patent
Katona et al.

(10) Patent No.: US 8,985,794 B1
(45) Date of Patent: Mar. 24, 2015

(54) PROVIDING REMOTE BLUE PHOSPHORS IN AN LED LAMP

(71) Applicant: Soraa, Inc., Fremont, CA (US)

(72) Inventors: Thomas M. Katona, Fremont, CA (US); Michael Ragan Krames, Fremont, CA (US)

(73) Assignee: Soraa, Inc., Fremont, CA (US)

( * ) Notice: Subject to any disclaimer, the term of this patent is extended or adjusted under 35 U.S.C. 154(b) by 170 days.

(21) Appl. No.: 13/856,613

(22) Filed: Apr. 4, 2013

Related U.S. Application Data

(60) Provisional application No. 61/625,592, filed on Apr. 17, 2012.

(51) Int. Cl.
*F21K 99/00* (2010.01)

(52) U.S. Cl.
CPC ..... *F21K 9/56* (2013.01)
USPC ..... 362/84

(58) Field of Classification Search
USPC ..... 362/84
See application file for complete search history.

(56) References Cited

U.S. PATENT DOCUMENTS

| | | | |
|---|---|---|---|
| 4,066,868 | A | 1/1978 | Witkin et al. |
| 4,350,560 | A | 9/1982 | Helgeland et al. |
| 4,581,646 | A | 4/1986 | Kubodera |
| 5,169,486 | A | 12/1992 | Young et al. |
| 5,764,674 | A | 6/1998 | Hibbs-Brenner et al. |
| 6,204,602 | B1 | 3/2001 | Yang et al. |
| 6,335,771 | B1 | 1/2002 | Hiraishi |
| 6,498,355 | B1 | 12/2002 | Harrah et al. |
| 6,501,154 | B2 | 12/2002 | Morita et al. |
| D471,881 | S | 3/2003 | Hegde |
| 6,787,999 | B2 | 9/2004 | Stimac et al. |

(Continued)

FOREIGN PATENT DOCUMENTS

| | | |
|---|---|---|
| CN | 2826150 Y | 10/2006 |
| CN | 2009-75612 | 11/2007 |

(Continued)

OTHER PUBLICATIONS

Thermal Properties of Plastic Materials', Professional Plastics, Aug. 21, 2010, p. 1-4.

(Continued)

*Primary Examiner* — Laura Tso
(74) *Attorney, Agent, or Firm* — Kilpatrick Townsend & Stockton LLP

(57) ABSTRACT

Light emitting devices and techniques for using remote blue phosphors in LED lamps are disclosed. An LED lamp is formed by configuring a first plurality of n of radiation sources to emit radiation characterized by a first wavelength, the first wavelength being substantially violet, and configuring a second plurality of m of radiation sources to emit radiation characterized by a second wavelength, the second wavelength also being substantially violet. Aesthetically-pleasing white light is emitted as the light from the radiation sources interacts with various wavelength converting materials (e.g., deposits of red-emitting materials, deposits of yellow/green-emitting materials, etc.) including a blue-emitting remote wavelength converting layer configured to absorb at least a portion of the radiation emitted by the first plurality of radiation sources. The remote wavelength converting layer emits wavelengths ranging from about 420 nm to about 520 nm.

22 Claims, 17 Drawing Sheets

(56) References Cited

U.S. PATENT DOCUMENTS 6,853,010 B2 2/2005 Slater, Jr. et al.
6,864,641 B2 3/2005 Dygert
6,956,246 B1 10/2005 Epler et al.
6,964,877 B2 11/2005 Chen et al.
6,989,807 B2 1/2006 Chiang
7,009,199 B2 3/2006 Hall
7,081,722 B1 7/2006 Huynh et al.
7,083,302 B2 8/2006 Chen et al.
7,113,658 B2 9/2006 Ide et al.
D545,457 S 6/2007 Chen
7,253,446 B2 8/2007 Sakuma et al.
7,279,040 B1 10/2007 Wang
7,311,417 B1 12/2007 Lemke
7,318,651 B2 1/2008 Chua et al.
7,344,279 B2 3/2008 Mueller et al.
7,358,543 B2 4/2008 Chua et al.
D581,583 S 11/2008 Peng
7,488,097 B2 2/2009 Reisenauer et al.
7,506,998 B2 3/2009 Ansems et al.
D592,613 S 5/2009 Plonski et al.
7,560,981 B2 7/2009 Chao et al.
7,637,635 B2 12/2009 Xiao et al.
7,658,528 B2 2/2010 Hoelen et al.
7,663,229 B2 2/2010 Lu et al.
7,674,015 B2 3/2010 Chien
D618,634 S 6/2010 Lin et al.
7,744,259 B2 6/2010 Walczak et al.
D619,551 S 7/2010 Lin et al.
7,748,870 B2 7/2010 Chang et al.
7,824,075 B2 11/2010 Maxik
7,889,421 B2 2/2011 Narendran et al.
7,906,793 B2 3/2011 Negley
7,972,040 B2 7/2011 Li et al.
7,993,031 B2 8/2011 Grajcar
8,044,412 B2 10/2011 Murphy et al.
8,044,609 B2 10/2011 Liu
D652,564 S 1/2012 Maxik
8,207,554 B2 6/2012 Shum
D662,899 S 7/2012 Shum et al.
D662,900 S 7/2012 Shum et al.
8,227,962 B1 7/2012 Su
8,269,245 B1 9/2012 Shum
8,272,762 B2 9/2012 Maxik et al.
8,324,835 B2 12/2012 Shum et al.
8,324,840 B2 12/2012 Shteynberg et al.
D674,960 S 1/2013 Chen et al.
8,362,603 B2 1/2013 Lim et al.
8,390,207 B2 3/2013 Dowling et al.
8,404,071 B2 3/2013 Cope et al.
8,405,947 B1 3/2013 Green et al.
8,410,711 B2 4/2013 Lin et al.
8,410,717 B2 4/2013 Shteynberg et al.
8,414,151 B2 4/2013 Allen et al.
8,519,437 B2 8/2013 Chakraborty
8,525,396 B2 9/2013 Shum et al.
8,541,951 B1 9/2013 Shum et al.
8,575,642 B1 11/2013 Shum
D694,722 S 12/2013 Shum et al.
8,618,742 B2 12/2013 Shum et al.
8,643,257 B2 2/2014 Shum et al.
8,803,452 B2 8/2014 Shum et al.
8,829,774 B1 9/2014 Shum et al.
2001/0021073 A1 9/2001 Leggo et al.
2001/0022495 A1 9/2001 Salam
2002/0088985 A1 7/2002 Komoto et al.
2003/0039122 A1 2/2003 Cao
2003/0058650 A1 3/2003 Shih
2004/0190304 A1 9/2004 Sugimoto et al.
2004/0201598 A1 10/2004 Eliav et al.
2004/0222427 A1 11/2004 Hsiung
2004/0227149 A1 11/2004 Ibbetson et al.
2004/0264195 A1 12/2004 Chang et al.
2005/0084218 A1 4/2005 Ide et al.
2005/0087753 A1 4/2005 D'Evelyn et al.
2005/0174780 A1 8/2005 Park
2005/0199899 A1 9/2005 Lin et al.
2005/0214992 A1 9/2005 Chakraborty et al.
2005/0224830 A1 10/2005 Blonder et al.
2006/0006404 A1 1/2006 Ibbetson et al.
2006/0038542 A1 2/2006 Park et al.
2006/0068154 A1 3/2006 Parce et al.
2006/0097385 A1 5/2006 Negley
2006/0118799 A1 6/2006 D'Evelyn et al.
2006/0124051 A1 6/2006 Yoshioka et al.
2006/0177362 A1 8/2006 D'Evelyn et al.
2006/0208262 A1 9/2006 Sakuma et al.
2006/0261364 A1 11/2006 Suehiro et al.
2006/0262545 A1 11/2006 Piepgras et al.
2006/0274529 A1 12/2006 Cao
2006/0288927 A1 12/2006 Chodelka et al.
2007/0007898 A1 1/2007 Bruning
2007/0114563 A1 5/2007 Paek et al.
2007/0126023 A1 6/2007 Haskell et al.
2007/0170450 A1 7/2007 Murphy
2007/0181895 A1 8/2007 Nagai
2007/0231963 A1 10/2007 Doan et al.
2007/0284564 A1 12/2007 Biwa et al.
2008/0049399 A1 2/2008 Lu et al.
2008/0054290 A1 3/2008 Shieh et al.
2008/0080137 A1 4/2008 Otsuki et al.
2008/0123341 A1 5/2008 Chiu
2008/0142781 A1 6/2008 Lee
2008/0158887 A1 7/2008 Zhu et al.
2008/0164489 A1 7/2008 Schmidt et al.
2008/0173884 A1 7/2008 Chitnis et al.
2008/0192791 A1 8/2008 Furukawa et al.
2008/0194054 A1 8/2008 Lin et al.
2008/0206925 A1 8/2008 Chatterjee et al.
2008/0266866 A1 10/2008 Tsai
2008/0284346 A1 11/2008 Lee
2008/0315228 A1 12/2008 Krames et al.
2009/0072252 A1 3/2009 Son et al.
2009/0134421 A1 5/2009 Negley
2009/0146170 A1 6/2009 Zhong et al.
2009/0154166 A1 6/2009 Zhang et al.
2009/0161356 A1 6/2009 Negley et al.
2009/0173958 A1 7/2009 Chakraborty et al.
2009/0175043 A1 7/2009 Frick
2009/0195186 A1 8/2009 Guest et al.
2009/0237940 A1 9/2009 Wu et al.
2009/0244899 A1 10/2009 Chyn
2009/0250686 A1 10/2009 Sato et al.
2009/0273005 A1 11/2009 Lin
2009/0309110 A1 12/2009 Raring et al.
2009/0321778 A1 12/2009 Chen et al.
2010/0001300 A1 1/2010 Raring et al.
2010/0006873 A1 1/2010 Raring et al.
2010/0025656 A1 2/2010 Raring et al.
2010/0060130 A1 3/2010 Li
2010/0061076 A1 3/2010 Mandy et al.
2010/0091487 A1 4/2010 Shin
2010/0148145 A1 6/2010 Ishibashi et al.
2010/0148210 A1 6/2010 Huang et al.
2010/0149814 A1 6/2010 Zhai et al.
2010/0155746 A1 6/2010 Ibbetson et al.
2010/0164403 A1 7/2010 Liu
2010/0207502 A1 8/2010 Cao et al.
2010/0207534 A1 8/2010 Dowling et al.
2010/0240158 A1 9/2010 Ter-Hovhannissian
2010/0244648 A1 9/2010 Yoo
2010/0258830 A1 10/2010 Ide et al.
2010/0264799 A1 10/2010 Liu et al.
2010/0277068 A1 11/2010 Broitzman
2010/0290229 A1 11/2010 Meyer, Sr. et al.
2010/0320499 A1 12/2010 Catalano et al.
2011/0032708 A1 2/2011 Johnston et al.
2011/0038154 A1 2/2011 Chakravarty et al.
2011/0056429 A1 3/2011 Raring et al.
2011/0068700 A1 3/2011 Fan
2011/0095686 A1 4/2011 Falicoff et al.
2011/0140586 A1 6/2011 Wang
2011/0169406 A1 7/2011 Weekamp et al.
2011/0175510 A1 7/2011 Rains, Jr. et al.
2011/0175528 A1 7/2011 Rains, Jr. et al.

(56) References Cited

U.S. PATENT DOCUMENTS

| | | | |
|---|---|---|---|
| 2011/0182065 | A1 | 7/2011 | Negley et al. |
| 2011/0186874 | A1 | 8/2011 | Shum |
| 2011/0198979 | A1 | 8/2011 | Shum et al. |
| 2011/0204763 | A1 | 8/2011 | Shum et al. |
| 2011/0204779 | A1 | 8/2011 | Shum et al. |
| 2011/0204780 | A1 | 8/2011 | Shum et al. |
| 2011/0242823 | A1 | 10/2011 | Tracy et al. |
| 2011/0309734 | A1 | 12/2011 | Lin et al. |
| 2011/0317397 | A1 | 12/2011 | Trottier et al. |
| 2012/0161626 | A1 | 6/2012 | van de Ven et al. |
| 2012/0187830 | A1 | 7/2012 | Shum et al. |
| 2012/0235201 | A1 | 9/2012 | Shum |
| 2012/0293062 | A1 | 11/2012 | Pickard |
| 2012/0299492 | A1 | 11/2012 | Egawa et al. |
| 2012/0313541 | A1 | 12/2012 | Egawa et al. |
| 2013/0043799 | A1 | 2/2013 | Siu et al. |
| 2013/0058099 | A1 | 3/2013 | Shum et al. |
| 2013/0313516 | A1 | 11/2013 | David et al. |
| 2013/0322089 | A1 | 12/2013 | Martis et al. |
| 2013/0343062 | A1 | 12/2013 | Shum et al. |
| 2014/0091697 | A1 | 4/2014 | Shum |
| 2014/0146545 | A1 | 5/2014 | Shum et al. |

FOREIGN PATENT DOCUMENTS

| | | |
|---|---|---|
| CN | 101608746 | 8/2011 |
| CN | 102149960 | 8/2011 |
| CN | 203099372 U | 7/2013 |
| JP | 02-028541 | 1/1990 |
| JP | 2000-517465 | 12/2000 |
| JP | 2006-147933 | 6/2006 |
| JP | 2005-302483 | 10/2009 |
| JP | 2011-501351 | 1/2011 |
| WO | WO 2009/048956 | 3/2009 |
| WO | WO 2009/066430 | 5/2009 |
| WO | WO 2009/149263 | 12/2009 |
| WO | WO 2009/156969 | 12/2009 |
| WO | WO 2011/010774 | 1/2011 |
| WO | WO 2011/054716 | 5/2011 |

OTHER PUBLICATIONS

USPTO Notice of Allowance for U.S. Appl. No. 13/269,193 dated Mar. 31, 2014 (8 pages).
USPTO Office Action for U.S. Appl. No. 13/274,489 dated Mar. 27, 2014 (14 pages).
USPTO Office Action for U.S. Appl. No. 13/480,767 dated Apr. 29, 2014 (21 pages).
Nakamura, 'Candela-Class High-Brightness InGaN/A1GaN Double-Heterostructure Blue-Light-Emitting Diodes', Applied Physics Letters, vol. 64, No. 13, Mar. 1994, pp. 1687-1689.
Communication from the Japanese Patent Office re 2012191931, dated Oct. 11, 2013, 4 pages.
Weaver et al., 'Optical Properties of Selected Elements', Handbook of Chemistry and Physics, 94th Edition, 2013-2014, pp. 12-126-12-150.
USPTO Office Action for U.S. Appl. No. 12/491,176 dated Nov. 22, 2013 (14 pages).
USPTO Office Action for U.S. Appl. No. 13/019,897 dated Dec. 2, 2013 (17 pages).
USPTO Notice of Allowance for U.S. Appl. No. 13/025,833 dated Oct. 11, 2013 (11 pages).
USPTO Office Action for U.S. Appl. No. 13/135,087 dated Sep. 27, 2013 (7 pages).
USPTO Office Action for U.S. Appl. No. 13/210,769 dated Oct. 28, 2013 (9 pages).
USPTO Office Action for U.S. Appl. No. 13/269,193 dated Oct. 3, 2013 (12 pages).
USPTO Office Action for U.S. Appl. No. 13/357,315 dated Oct. 15, 2013 (12 pages).
USPTO Office Action for U.S. Appl. No. 13/480,767 dated Oct. 25, 2013 (28 pages).
USPTO Notice of Allowance for U.S. Appl. No. 13/482,956 dated Oct. 28, 2013 (9 pages).
USPTO Office Action for U.S. Appl. No. 13/535,142 dated Nov. 14, 2013 (23 pages).
USPTO Office Action for U.S. Appl. No. 13/959,422 dated Oct. 8, 2013 (10 pages).
USPTO Office Action for U.S. Appl. No. 13/535,142 dated Feb. 25, 2014, 23 pages.
Csuti et al., 'Color-matching experiments with RGB-LEDs', Color Research and Application, vol. 33, No. 2, 2008, pp. 1-9.
Davis et al., 'Color Quality Scale', Optical Engineering 49(3), 2010, pp. 033602-1-16.
Haskell et al., 'Defect Reduction in (1100) m-plane gallium nitride via lateral epitaxial overgrowth by hydride vapor phase epitaxy', Applied Physics Letters 86, 111917 (2005), pp. 1-3.
Iso et al., 'High Brightness Blue InGaN/GaN Light Emitting Diode on Nonpolar m-Plane Bulk GaN Substrate', Japanese Journal of Applied Physics, vol. 46, No. 40, 2007, pp. L960-L962.
Paper and Board Determination of CIE Whiteness, D65/10 (outdoor daylight)', ISO International Standard 11475:2004E (2004), 18 pgs.
International Preliminary Report & Written Opinion of PCT Application No. PCT/US2011/060030 dated Mar. 21, 2012, 11 pgs. total.
CFL Ballast IC Drive LED', www.placardshop.com, Blog, May 22, 2012, 3 pgs.
Rausch, 'Use a CFL ballast to drive LEDs', EDN Network, 2007, pp. 1-2.
Sato et al., 'Optical Properties of Yellow Light-Emitting Diodes Grown on Semipolar (1122) Bulk GaN Substrate', Applied Physics Letters, vol. 92, No. 22, 2008, pp. 221110-1-221110-3.
Whitehead et al., 'A Monte Carlo method for assessing color rendering quality with possible application to color rendering standards', Color Research and Application, vol. 37, No. 1, Feb. 2012, pp. 13-22.
USPTO Office Action for U.S. Appl. No. 12/481,543 dated Jun. 27, 2011.
USPTO Office Action for U.S. Appl. No. 12/491,176 dated Mar. 1, 2012.
USPTO Office Action for U.S. Appl. No. 12/491,176 dated Jul. 19, 2012.
USPTO Office Action for U.S. Appl. No. 12/785,953 dated Apr. 12, 2012.
USPTO Office Action for U.S. Appl. No. 12/785,953 dated Jan. 11, 2013.
USPTO Office Action for U.S. Appl. No. 12/879,784 dated Jan. 25, 2012.
USPTO Notice of Allowance for U.S. Appl. No. 12/879,784 dated Apr. 3, 2012.
USPTO Office Action for U.S. Appl. No. 12/914,789 dated Oct. 12, 2011.
USPTO Office Action for U.S. Appl. No. 12/914,789 dated Feb. 24, 2012.
USPTO Notice of Allowance for U.S. Appl. No. 12/914,789 dated May 17, 2012.
USPTO Office Action for U.S. Appl. No. 13/019,897 dated Mar. 30, 2012.
USPTO Office Action for U.S. Appl. No. 13/019,897 dated Jan. 16, 2013.
USPTO Office Action for U.S. Appl. No. 13/025,791 dated Nov. 25, 2011.
USPTO Office Action for U.S. Appl. No. 13/025,791 dated Feb. 20, 2013.
USPTO Notice of Allowance for U.S. Appl. No. 13/025,791 dated Jun. 17, 2013.
USPTO Office Action for U.S. Appl. No. 13/025,833 dated Dec. 14, 2011.
USPTO Office Action for U.S. Appl. No. 13/025,833 dated Jul. 12, 2012.
USPTO Office Action for U.S. Appl. No. 13/025,833 dated Apr. 26, 2013.
USPTO Office Action for U.S. Appl. No. 13/025,849 dated Mar. 15, 2013.
USPTO Office Action for U.S. Appl. No. 13/025,860 dated Dec. 30, 2011.

(56) References Cited

OTHER PUBLICATIONS

USPTO Notice of Allowance for U.S. Appl. No. 13/025,860 dated Jun. 8, 2012.
USPTO Office Action for U.S. Appl. No. 13/210,769 dated Apr. 4, 2013.
USPTO Notice of Allowance for U.S. Appl. No. 13/298,905 dated Jun. 11, 2013.
USPTO Office Action for U.S. Appl. No. 13/482,956 dated Aug. 17, 2012.
USPTO Office Action for U.S. Appl. No. 13/482,956 dated Feb. 14, 2013.
USPTO Notice of Allowance for U.S. Appl. No. 29/399,523 dated Mar. 5, 2012.
USPTO Notice of Allowance for U.S. Appl. No. 29/399,524 dated Mar. 2, 2012.
Communication from the Japanese Patent Office re 2013532993 dated Jul. 9, 2014 (5 pages).
USPTO Notice of Allowance for U.S. Appl. No. 13/959,422 dated Jul. 9, 2014 (7 pages).
Benke et al., 'Uncertainty in Health Risks from Artificial Lighting due to Disruption of Circadian Rythm and Melatonin Secretion: A Review', Human and Ecological Risk Assessment: An International Journal, vol. 19, No. 4, 2013, pp. 916-929.
Hanifin et al., 'Photoreception for Circadian, Neuroendocrine, and Neurobehavioral Regulation', Journal of Physiological Anthropology, vol. 26, 2007, pp. 87-94.
Houser et al., 'Review of measures for light-source color rendition and considerations for a two-measure system for characterizing color rendition', Optics Express, vol. 21, No. 8, Apr. 19, 2013, pp. 10393-10411.
Rea et al., 'White Lighting', Color Research and Application, vol. 38, No. 2, Sep. 3, 2011, pp. 82-92.
USPTO Notice of Allowance for U.S. Appl. No. 13/025,849 dated Sep. 16, 2013, 10 pages.
USPTO Office Action for U.S. Appl. No. 13/274,489 dated Sep. 6, 2013, 13 pages.
USPTO Office Action for U.S. Appl. No. 13/482,956 dated Jul. 22, 2013, 17 pages.
USPTO Office Action for U.S. Appl. No. 13/535,142 dated Aug. 1, 2013, 14 pages.
USPTO Office Action for U.S. Appl. No. 13/600,988 dated Jul. 18, 2013, 13 pages.
USPTO Notice of Allowance for U.S. Appl. No. 13/600,988 dated Sep. 16, 2013, 9 pages.
USPTO Notice of Allowance for U.S. Appl. No. 29/423,725 dated Jul. 19, 2013, 11 pages.

PROVIDING REMOTE BLUE PHOSPHORS IN AN LED LAMP

This application claims the benefit under 35 U.S.C. §119(e) of U.S. Provisional Application No. 61/625,592 filed on Apr. 17, 2012, which is incorporated by reference in its entirety.

FIELD

The present disclosure relates generally to light emitting devices and, more particularly, to techniques for using remote blue phosphors in lamps comprising light emitting devices.

BACKGROUND

Legacy LED light bulbs and fixtures use blue-emitting diodes in combination with phosphors or other wavelength-converting materials emitting red, and/or green, and/or yellow light. The combination of blue emitting LEDs and red-emitting and green- and/or yellow-emitting materials is intended to aggregate to provide a spectrum of wavelengths, which spectrum is perceived by a human as white light. However, although the resulting spectrum is intended to be perceived by a human as white light, many human subjects report that the light is significantly color-shifted. The reported color shifting makes such legacy LED lamps and fixtures inappropriate for various applications. Various attempts to improve upon legacy techniques have proven ineffective and/or inefficient.

Further, uses of green- and/or yellow-emitting materials in the exterior structure of a lamp that can be seen by a user are often regarded as undesirable, especially because the aesthetics of interior lighting has traditionally been based on a white or near-white exterior structure (e.g., as in the case of a legacy, incandescent, "Edison" bulb).

In some legacy LED lamps, blue LEDs are used in conjunction with down-converting phosphors embedded in an encapsulant, which encapsulant is disposed directly atop or in close proximity to the violet LEDs. However short wavelength light (e.g., blue light) is known to degrade the materials used in encapsulants, thus limiting the useful lifetime of the lamp.

SUMMARY

An improved approach involving the use of LEDs emitting wavelengths other than the legacy blue-emitting LEDs is provided herein.

In a first aspect, LED lamps are provided comprising: a first plurality of n radiation sources configured to emit radiation characterized by a first wavelength, the first wavelength being substantially violet; a second plurality of m radiation sources configured to emit radiation characterized by a second wavelength, the second wavelength being substantially violet; and a first wavelength converting layer configured to absorb at least a portion of the radiation emitted by the first plurality of radiation sources, the first wavelength converting layer having an emission wavelength ranging from about 420 nm to about 520 nm.

In a second aspect, LED lamps are provided comprising: a first plurality of n radiation sources configured to emit radiation characterized by a first wavelength, the first wavelength being substantially blue; and a second plurality of m radiation sources configured to emit radiation characterized by a second wavelength, the second wavelength being substantially violet; and a first wavelength converting layer configured to absorb at least a portion of radiation emitted by the second plurality of radiation sources, the first wavelength converting layer having an emission wavelength ranging from about 500 nm to about 750 nm.

In a third aspect, LED lamps with an outer surface having a white appearance under ambient light are provided, comprising: a light source; an outer surface, the outer surface positioned to form a remote structural member; a first wavelength converting layer disposed on the remote structural member, the first wavelength converting layer configured to absorb at least a portion of radiation emitted by the light source, the first wavelength converting layer having an emission wavelength ranging from about 420 nm to about 520 nm; and a second wavelength converting layer disposed on the remote structural member, the second wavelength converting layer having an emission wavelength ranging from about 490 nm to about 630 nm.

DETAILED DESCRIPTION OF THE DISCLOSURE

Figure 1A:
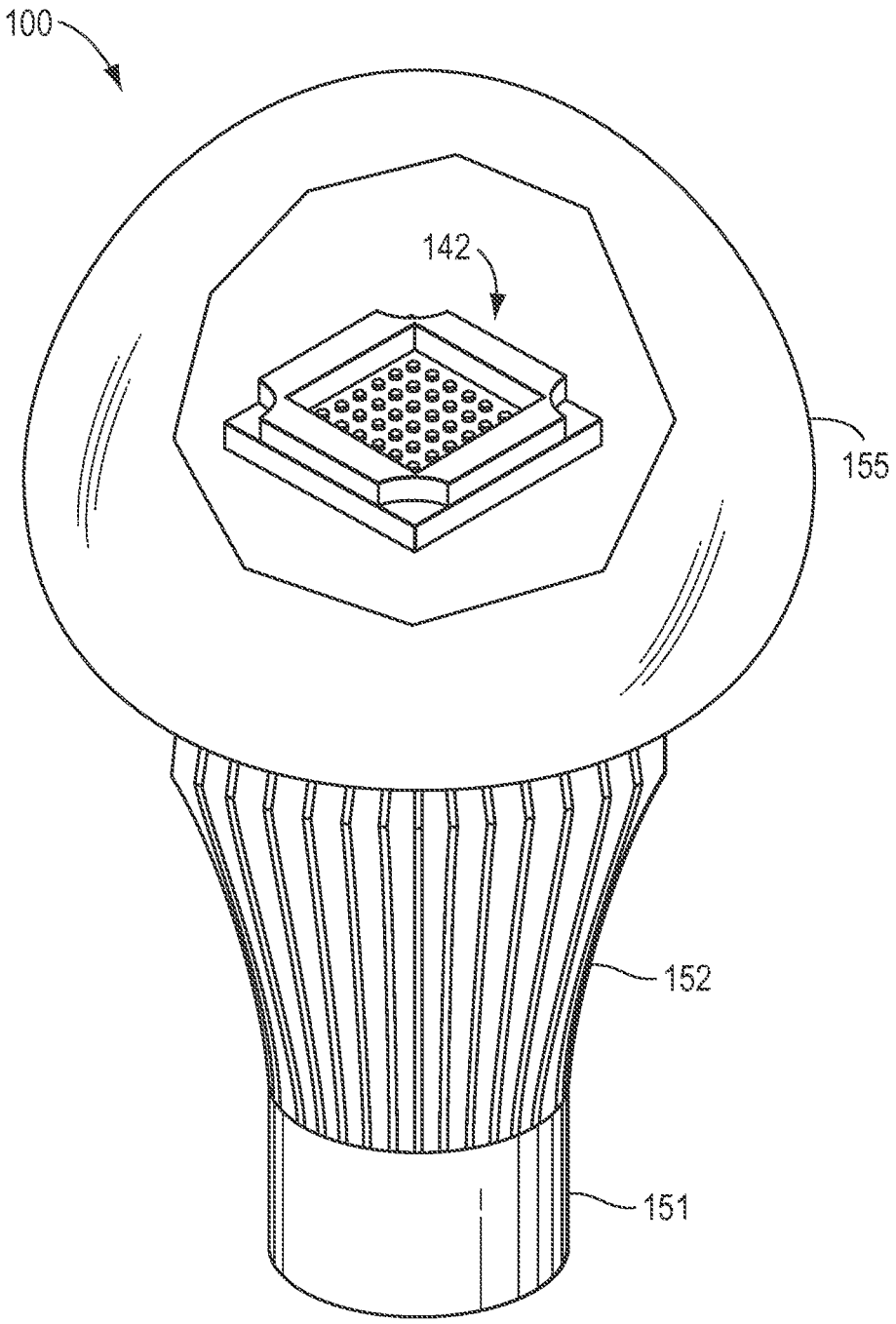
FIG. 1A is a diagram illustrating an LED lamp having a base to provide a mount point for a light source, according to some embodiments.

Various types of phosphor-converted (pc) light-emitting diodes (LEDs) have been proposed in the past. Conventional pc LEDs include a blue LED with various phosphors (e.g., in yellow and red combinations, in green and red combinations, in red and green and blue combinations). Various attempts have been made to combine the blue light-emissions of the blue LEDS with phosphors to provide color control.

According to some embodiments of the present disclosure, a substantially white light lamp is formed by combining wavelength-converting material that emits substantially blue light (e.g., phosphors) with LEDs that emit red, green, and/or violet (but not blue) light. In some embodiments, the combination is provided in a form factor to serve as an LED light source (e.g., a light bulb, a lamp, a fixture, etc.).

As disclosed herein, the use of green- and/or yellow-emitting materials in the exterior structure of a lamp that can be seen by a user is often regarded as undesirable, especially because the aesthetics of interior lighting has been based on a white or near-white exterior structure (e.g., as in the case of a legacy, incandescent, "Edison" bulb). In addition to the herein-described utility, one aspect that influences the design of more desirable embodiments is a human's perception of aesthetics. Many of the LED systems disclosed herein comprise of an LED lamp having an exterior structure such as a "bulb", or "dome", or encasement, or glass portion, or outer surface, etc. that, when viewed in natural light (e.g., in sunlight, in interior lighting settings, in ambient light, etc.) appear as a substantially white "bulb", or "dome" or "outer surface". Still further, the use blue-emitting wavelength-converting materials in the fabrication of the aforementioned substantially white bulb, or dome results in imparting optical scattering properties to the dome, such that the dome appears as "soft white".

In addition to the aesthetics that consequently result from the herein-described embodiments, such embodiments exhibit exceptionally high efficiency in terms of perceived optical wattage with respect to electrical power consumed. For example, most humans report that perceived light output (e.g., brightness, candlepower, lumens, etc.) is substantially more determined by the presence of yellow and/or green light as compared to the presence of blue light. Some human subjects report that added light in the wavelength range of green and/or yellow is up to five times more perceptible than is added light in the wavelength range of blue light.

Table 1 shows an example of various LED pump and phosphor emitting peak wavelengths that could be utilized to generate white light according to embodiments provided by the present disclosure.

TABLE 1

| | Blue | Yellow/ Green | Red |
|---|---|---|---|
| Emission Peak (nm) | 450 | 530 | 620 |
| LED Pump (nm) | 400-420 | 415-435 | 415-435 |

In addition to the aforementioned benefits of combining wavelength-converting material (e.g., phosphors) that emits substantially blue light with LEDs that emit violet, and/or red, and/or green light, it is known that longer wavelengths (e.g., red, and/or green light) do not cause degradation of silicone and other materials used in lamps. Thus, configuring LED lamps that avoid the use of blue-emitting LEDs (or other short-wavelength colors) in close proximity to any silicone encapsulants has a desirable effect on the longevity of such LED lamps.

FIG. 1A is a diagram illustrating an LED lamp 100 having a base to provide a mount point for a light source, according to some embodiments. It is to be appreciated that an LED lamp 100, according to the present disclosure, can be implemented for various types of applications. As shown in FIG. 1A, a light source (e.g., the light source 142) is a part of the LED lamp 100. The LED lamp 100 includes a base member 151. The base member 151 is mechanically connected to a heat sink 152, and the heat sink is mechanically coupled to a remote structural member 155 (e.g., a bulb or a dome). In certain embodiments, the base member 151 is compatible with a conventional light bulb socket and is used to provide electrical power (e.g., using an AC power source) to one or more radiation emitting devices (e.g., one or more instances of light source 142). In certain embodiments, the base member 151 is compatible with an MR-16 socket and is used to provide electrical power (e.g., using an AC power source) to the one or more radiation emitting devices (e.g., one or more instances of light source 142). The base member 151 can conform to any of a set of standards for the base. For example Table 2 gives standards (see "Designation") and corresponding characteristics.

TABLE 2

| Designation | Base Diameter (Crest of thread) | Name | IEC 60061-1 standard sheet |
|---|---|---|---|
| E05 | 5 mm | Lilliput Edison Screw (LES) | 7004-25 |
| E10 | 10 mm | Miniature Edison Screw (MES) | 7004-22 |
| E11 | 11 mm | Mini-Candelabra Edison Screw (mini-can) | (7004-6-1) |
| E12 | 12 mm | Candelabra Edison Screw (CES) | 7004-28 |
| E14 | 14 mm | Small Edison Screw (SES) | 7004-23 |
| E17 | 17 mm | Intermediate Edison Screw (IES) | 7004-26 |
| E26 | 26 mm | [Medium] (one-inch) Edison Screw (ES or MES) | 7004-21A-2 |
| E27 | 27 mm | [Medium] Edison Screw (ES) | 7004-21 |
| E29 | 29 mm | [Admedium] Edison Screw (ES) | |
| E39 | 39 mm | Single-contact (Mogul) Giant Edison Screw (GES) | 7004-24-A1 |
| E40 | 40 mm | (Mogul) Giant Edison Screw (GES) | 7004-24 |

Additionally, the base member 151 can be of any form factor configured to support electrical connections, which electrical connections can conform to any of a set of types or standards. For example Table 3 gives standards (see "Type") and corresponding characteristics, including mechanical spacings between a first pin (e.g., a power pin) and a second pin (e.g., a ground pin).

TABLE 3

| Type | Standard | Pin center to center | Pin diameter | Usage |
|---|---|---|---|---|
| G4 | IEC 60061-1 (7004-72) | 4.0 mm | 0.65-0.75 mm | MR11 and other small halogens of 5/10/20 watt and 6/12 volt |
| GU4 | IEC 60061-1 (7004-108) | 4.0 mm | 0.95-1.05 mm | |
| GY4 | IEC 60061-1 (7004-72A) | 4.0 mm | 0.65-0.75 mm | |
| GZ4 | IEC 60061-1 (7004-64) | 4.0 mm | 0.95-1.05 mm | |
| G5 | IEC 60061-1 (7004-52-5) | 5 mm | | T4 and T5 fluorescent tubes |
| G5.3 | IEC 60061-1 (7004-73) | 5.33 mm | 1.47-1.65 mm | |
| G5.3-4.8 | IEC 60061-1 (7004-126-1) | | | |
| GU5.3 | IEC 60061-1 (7004-109) | 5.33 mm | 1.45-1.6 mm | |
| GX5.3 | IEC 60061-1 (7004-73A) | 5.33 mm | 1.45-1.6 mm | MR16 and other small halogens of 20/35/50 watt and 12/24 volt |
| GY5.3 | IEC 60061-1 (7004-73B) | 5.33 mm | | |
| G6.35 | IEC 60061-1 (7004-59) | 6.35 mm | 0.95-1.05 mm | |
| GX6.35 | IEC 60061-1 (7004-59) | 6.35 mm | 0.95-1.05 mm | |
| GY6.35 | IEC 60061-1 (7004-59) | 6.35 mm | 1.2-1.3 mm | Halogen 100 W 120 V |
| GZ6.35 | IEC 60061-1 (7004-59A) | 6.35 mm | 0.95-1.05 mm | |
| G8 | | 8.0 mm | | Halogen 100 W 120 V |
| GY8.6 | | 8.6 mm | | Halogen 100 W 120 V |
| G9 | IEC 60061-1 (7004-129) | 9.0 mm | | Halogen 120 V (US)/230 V (EU) |
| G9.5 | | 9.5 mm | 3.10-3.25 mm | Common for theatre use, several variants |
| GU10 | | 10 mm | | Twist-lock 120/230-volt MR16 halogen lighting of 35/50 watt, since mid-2000s |
| G12 | | 12.0 mm | 2.35 mm | Used in theatre and single-end metal halide lamps |
| G13 | | 12.7 mm | | T8 and T12 fluorescent tubes |
| G23 | | 23 mm | 2 mm | |
| GU24 | | 24 mm | | Twist-lock for self-ballasted compact fluorescents, since 2000s |
| G38 | | 38 mm | | Mostly used for high-wattage theatre lamps |
| GX53 | | 53 mm | | Twist-lock for puck-shaped under-cabinet compact fluorescents, since 2000s |

Figure 1B:
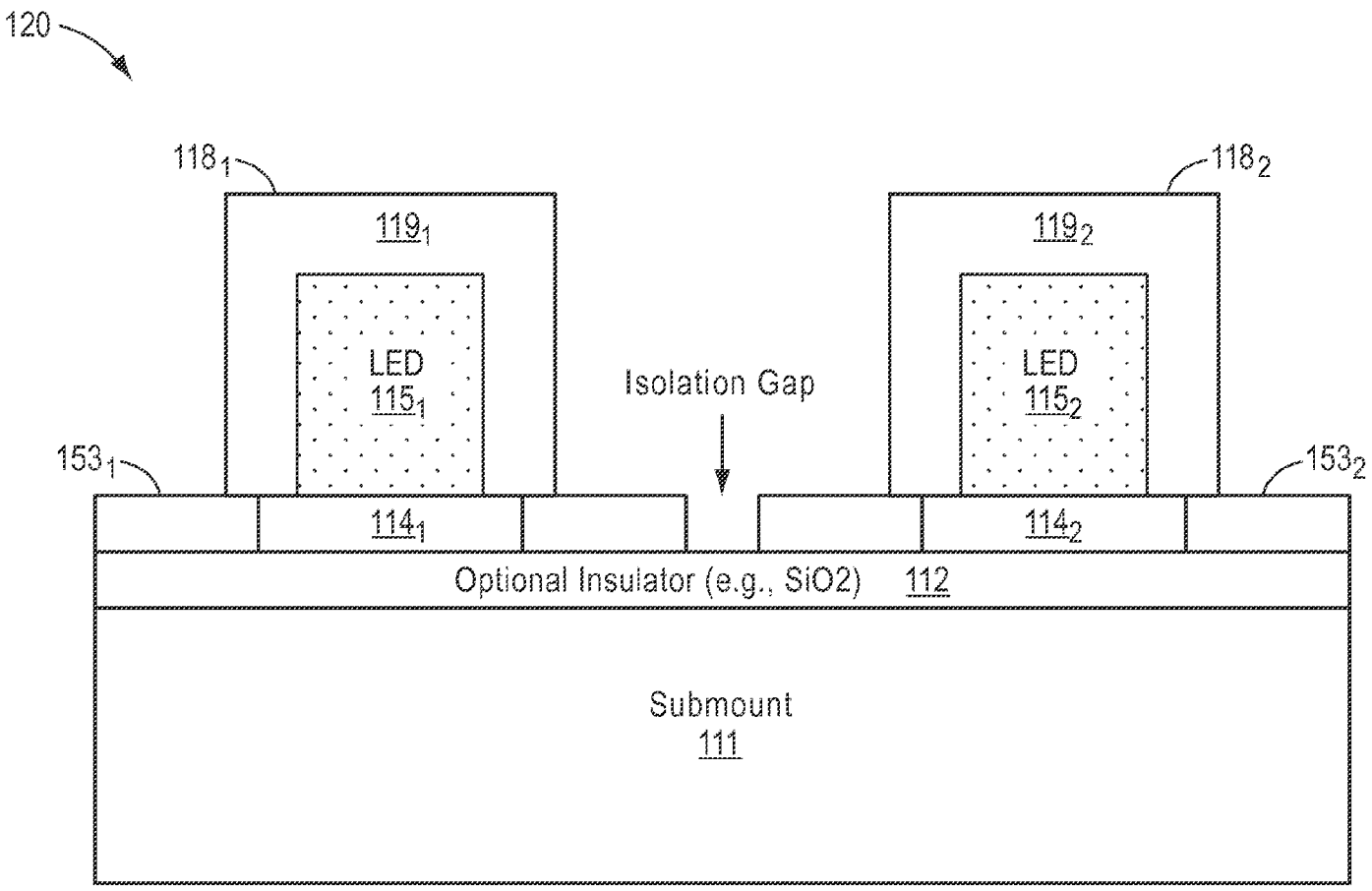
FIG. 1B is a diagram illustrating construction of a radiation source comprised of light emitting diodes, according to some embodiments.

FIG. 1B is a diagram illustrating construction of a radiation source 120 comprising LED devices.

In certain embodiments, the LED devices (e.g., LED device $\mathbf{115}_1$, LED device $\mathbf{115}_2$) emit substantially only red and/or green and/or violet (but not blue) light. The substantially only red and/or green and/or violet emitting LED devices represent one configuration, and other configurations are reasonable and envisioned.

As shown in FIG. 1B, the radiation source 120 is constructed on a submount 111 upon which submount is a layer of sapphire or other optional insulator 112, upon which are disposed one or more conductive contacts (e.g., conductive contact $\mathbf{114}_1$, conductive contact $\mathbf{114}_2$), arranged in an array where each conductive contact is spatially separated from other conductive contacts by an isolation gap. Further disposed atop the submount or atop the insulator are one or more deposits (e.g., deposit $\mathbf{153}_1$, deposit $\mathbf{153}_2$) of wavelength-modifying material configured to modify the color of the light generated by LED devices. Various mixes of colors can be achieved using a deposit (e.g., deposit $\mathbf{153}_1$, deposit $\mathbf{153}_2$) of wavelength-modifying material disposed in proximity to the radiation sources.

FIG. 1B shows LED devices in a linear array, however other array configurations are possible, for example, as described herein. As shown, atop the conductive contacts are LED devices (e.g., LED device $\mathbf{115}_1$, LED device $\mathbf{115}_2$). The LED device is but one possibility for a radiation source, and other radiation sources are possible and envisioned, for example a radiation source can be a laser device.

In certain embodiments, the devices and packages disclosed herein include at least one non-polar or at least one semi-polar radiation source (e.g., an LED or laser) disposed on a submount. The starting materials can comprise polar gallium nitride containing materials.

The radiation source 120 is not to be construed as conforming to a specific drawing scale, and in particular, many structural details are not included in FIG. 1B so as not to obscure understanding of the embodiments. The isolation gap serves to facilitate shaping of materials formed in and around the isolation gap, which formation can be by one or more additive processes, or by one or more subtractive processes, or both.

It is to be appreciated that the radiation sources illustrated in FIG. 1B can output light in a variety of wavelengths (e.g., colors) according to various embodiments of the present disclosure. Depending on the application, color balance can be achieved by modifying color generated by LED devices and/or configuring and using wavelength-modifying material (e.g., a phosphor material).

In certain embodiments, color balance can be achieved by modifying the color of the light generated by LED devices by using a deposit (e.g., deposit $\mathbf{153}_1$, deposit $\mathbf{153}_2$) of wavelength-modifying material disposed in proximity to the radiation source.

In certain embodiments, the phosphor material may be mixed with an encapsulant such as a silicone material (e.g., encapsulating material $\mathbf{118}_1$, encapsulating material $\mathbf{118}_2$) or other encapsulant that distributes phosphor color pixels (e.g., pixel $\mathbf{119}_1$, pixel $\mathbf{119}_2$) within a thin layer atop and/or surrounding any one or more faces of the LED devices in the array of LED devices. Other embodiments for providing color pixels can be conveniently constructed using techniques that form deposits of one or more wavelength-modifying materials.

As is known in the art, silicone degrades more quickly when exposed to a high flux of higher-energy photons (e.g., shorter wavelength light). Thus, embodiments that employ lower energy radiation sources (e.g., red or green LEDs) reduce the rate of degradation of the silicone components of an LED lamp. Embodiments employing red and green LEDs are further discussed herein.

Figure 1C:
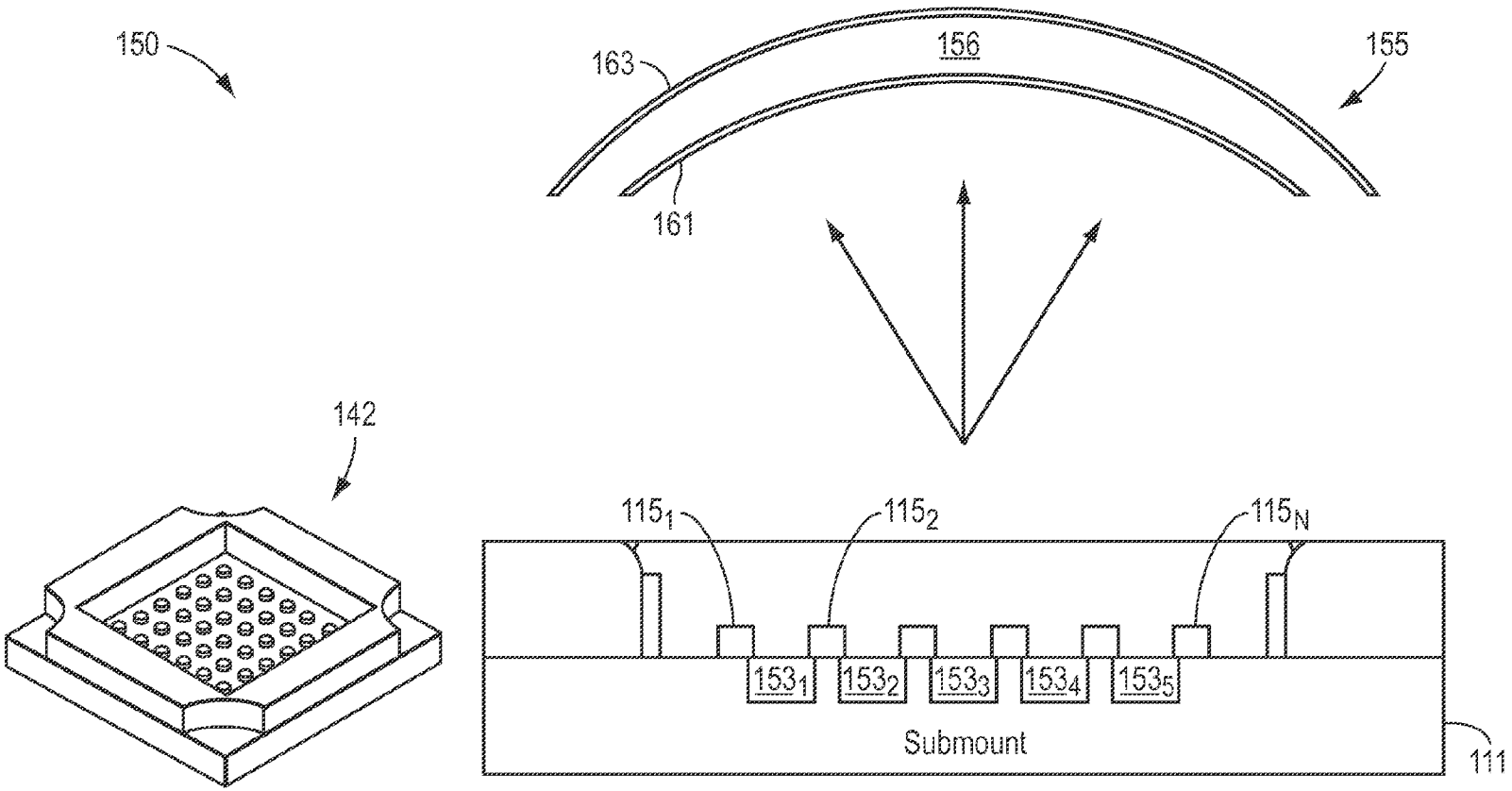
FIG. 1C is a diagram illustrating an optical device embodied as a light source constructed using an array of LEDs, according to some embodiments.

FIG. 1C is a diagram illustrating an optical device 150 embodied as a light source 142 constructed using an array of LED devices (e.g., LED device $\mathbf{115}_1$, LED device $\mathbf{115}_2$, LED device 115$_N$, etc.) juxtaposed with a remotely-located instance of a remote structural member 155, the remote structural member 155 having instances of wavelength converting materials (e.g., pixels, deposits) distributed upon or within the volume 156 of the remote structural member 155, which volume is bounded by a remote structural member inner surface 161 and a remote structural member outer surface 163, according to certain embodiments.

In addition to the wavelength converting materials distributed upon or within the volume 156 of the remote structural member 155, some embodiments include deposits of wavelength converting materials (e.g., deposit 153$_1$, deposit 153$_2$, deposit 153$_3$, deposit 153$_4$, deposit 153$_5$, etc.) disposed in close proximity to the LED devices. As shown, wavelength-modifying material (e.g., deposit 153$_1$, deposit 153$_2$, deposit 153$_3$, deposit 153$_4$, deposit 153$_5$, etc.) can be disposed and distributed in a variety of configurations, including being deposited in a cup structure, or being deposited in a layer disposed atop the LED device.

Individually, and together, these color pixels modify the color of light emitted by the LED devices. For example, the color pixels are used to modify the light from LED devices to appear as white light having a uniform broadband emission (e.g., characterized by a substantially flat emission of light throughout the range of about 380 nm to about 780 nm), which is suitable for general lighting.

In various embodiments, color balance adjustment is accomplished by using pure color pixels, mixing phosphor material, and/or using a uniform layer of phosphor over LED devices, and/or using pixels distributed in a location substantially remote from the LED device, For example, in various embodiments, color balance adjustment is accomplished by using pixels (e.g., blue-emitting pixels) distributed in a location substantially remote from the LED devices (e.g., the blue-emitting pixels being distributed upon or within the volume 156 of the remote structural member 155).

Figure 1D:
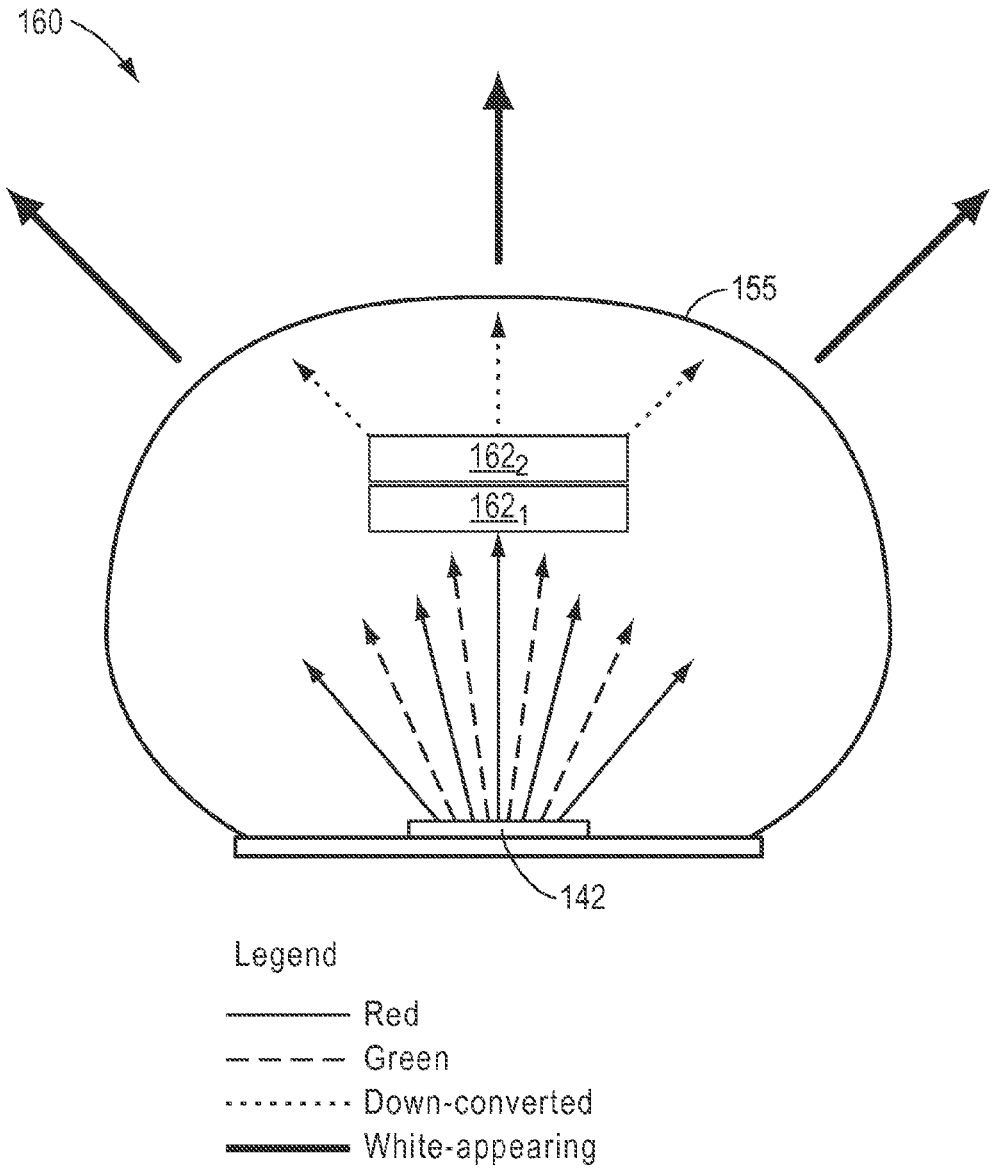
FIG. 1D is a diagram illustrating an apparatus with a down-converting member having a phosphor mix, according to an embodiment of the disclosure.

In certain embodiments, wavelength converting processes are facilitated by using one or more pixilated phosphor wavelength-modifying layers (e.g., see FIG. 1D, infra). For example, the pixilated phosphor wavelength-modifying layers can include color patterns. The color patterns of the phosphors disposed within the wavelength-modifying layer may be predetermined based on the measured color balance of the aggregate emitted light. In certain embodiments, an absorption plate is used to perform color correction. In some situations, the absorption plate comprises color absorption material. For example, the absorbing and/or reflective material can be plastic, ink, die, glue, epoxy, and others.

In certain embodiments, the phosphor particles are embedded in a reflective matrix (e.g., the matrix formed by conductive contacts). Such phosphor particles can be disposed on the substrate by deposition. In certain embodiments, the reflective matrix comprises silver or other suitable material. Alternatively, one or more colored pixilated reflector plates (not shown) are provided to adjust aggregate color balance of the light emitted from LED devices aggregated with light emitted from wavelength-modifying materials. In certain embodiments, materials such as aluminum, gold, platinum, chromium, and/or others are deposited to provide color balance.

FIG. 1D is a diagram illustrating an apparatus 160 with a down-converting member having a phosphor mix. As shown, the down-converting member includes a plurality of wavelength-modifying layers (e.g., wavelength-modifying layer 162$_1$, wavelength-modifying layer 162$_2$), the wavelength-modifying layers comprising phosphor materials. The phosphor materials are excited by radiation emitted by light source 142. The combination of the colors of the light emissions from the radiations sources and the light emissions from the wavelength-modifying layers and the light emissions from the blue-emitting wavelength conversion materials disposed in or on the dome (e.g., remote structural member 155) produce white-appearing light.

In certain embodiments, the apparatus 160 may be present in embodiments of an LED lamp of the present disclosure. In certain embodiments, of an LED lamp the apparatus 160 may be absent, or, one or more layers of phosphor materials may disposed directly atop an LED device, or otherwise overlaying an LED device in very close proximity to the LED device. For example, an encapsulant can be used to distribute phosphor materials within the encapsulant, and the encapsulant can be disposed in a manner overlaying LED device, and where the encapsulant is disposed in very close proximity to the LED device.

Figure 1E:
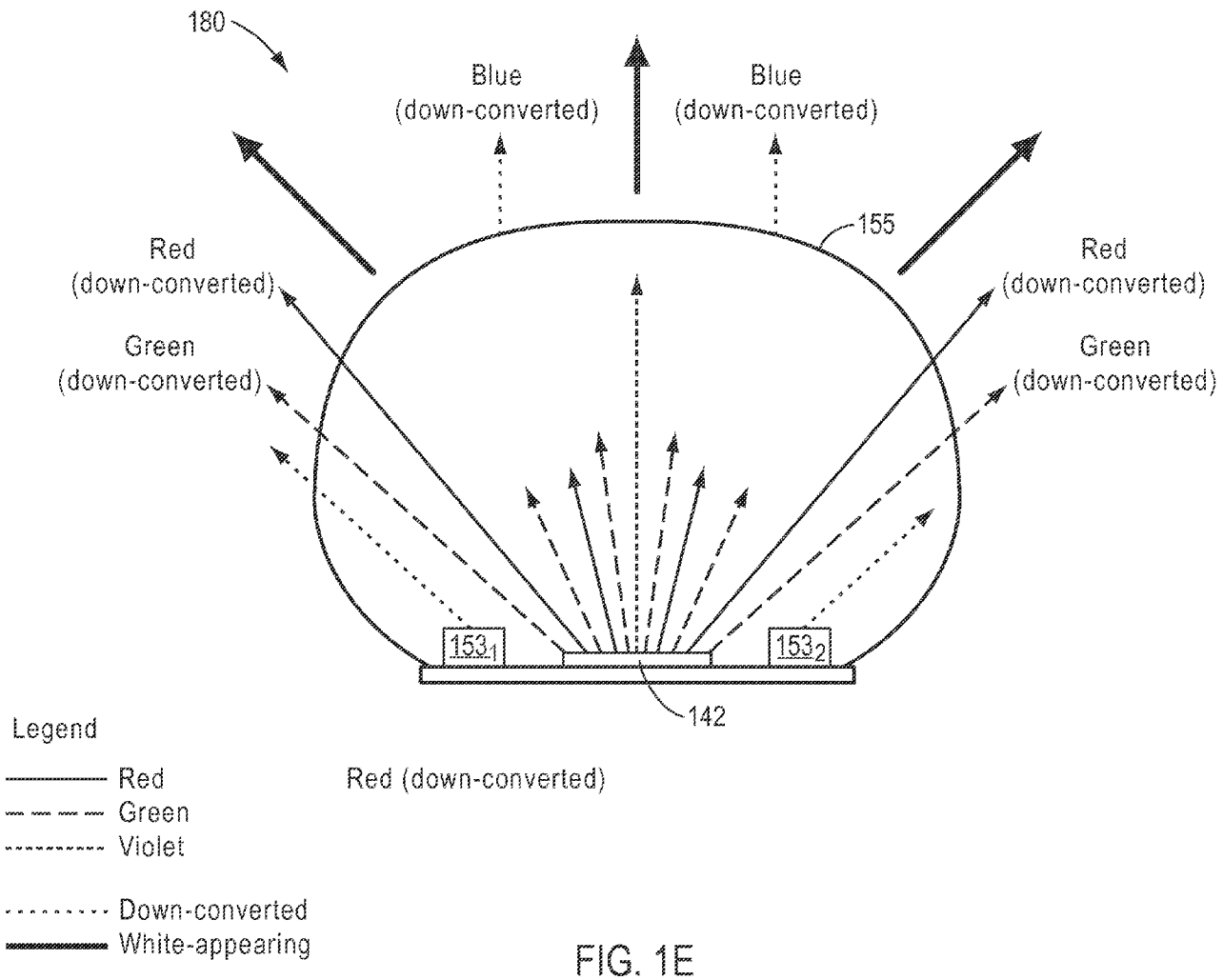
FIG. 1E is a side view illustrating a remote blue phosphor dome for generating white light, according to an embodiment of the disclosure.

FIG. 1E is a side view 180 illustrating another embodiment having a remote blue phosphor dome for generating white light. As shown, a light source 142 comprises radiation sources that emit some combination of red light and green light and violet light (but not blue light), which radiation sources are provided for radiating light toward a dome (e.g., remote structural member 155). In this embodiment the remote blue phosphor dome (e.g., remote structural member 155) is shaped like a conventional light bulb, which shape is not only aesthetically pleasing, but also the shape serves to produce light that is substantially omni-directional in intensity.

The combination of the colors of the light emissions from the radiation sources produces white-appearing light. For example, the embodiment as shown in side view 180 can comprise violet LEDs in combination with yellow-emitting and/or green-emitting down-converting materials as disposed in encapsulants, or as disposed in deposits 153$_1$ and 153$_2$. Additionally, blue-emitting down-converting materials disposed in or on the dome, which blue-emitting down-converting materials absorb violet emissions. The combination of emissions from these sources results in an aggregate color tuning that produces a white-appearing light.

In certain embodiments, the combination of the colors of the light emissions from the radiations sources produces white-appearing light. For example violet LEDs, can be configured in combination with yellow-emitting and/or green-emitting down-converting materials as disposed in encapsulants, and yellow-emitting and/or green-emitting down-converting materials as disposed in or on the dome, which yellow-emitting and/or green-emitting down-converting materials disposed in or on the dome can be mixed with blue-emitting down-converting materials also disposed in or on the dome. The combination of emissions from these sources results in an aggregate color tuning that produces a white-appearing light.

The selected embodiments of bulbs having a remote blue phosphor dome for generating white light are merely exemplary. Other bulb types are envisioned and possible. Table 4 list a subset of possible bulb types for LED lamps.

TABLE 4

Bulb Types for Lamps

| Bulb Category | Type |
|---|---|
| Incandescent | A-Shape<br>Candle Bulb<br>Globe<br>Bulged Reflector |

TABLE 4-continued

| Bulb Types for Lamps | |
|---|---|
| Bulb Category | Type |
| | B-Type |
| | BA-Type |
| | G-Type |
| | J-Type |
| | S-Type |
| | SA-Type |
| | F-Type |
| | T-Type |
| | Y-Type |
| Fluorescent | T-4 |
| | T-5 |
| | T-8 |
| | T-12 |
| | Circline |
| ANSI | ANSI C |
| | ANSI G |
| Halogen | A-Type |
| | Aluminum Reflector |
| | Post Lamps (e.g., BT15) |
| | MR |
| | PAR |
| | Bulged Reflector |
| HID | ED-Type |
| | ET-Type |
| | B-Type |
| | BD-Type |
| | T-Type |
| | E-Type |
| | A-Type |
| | BT-Type |
| CFL | Single Twin Tube |
| | Double Twin Tube |
| | Triple Twin Tube |
| | Spiral |

Figure 1F:
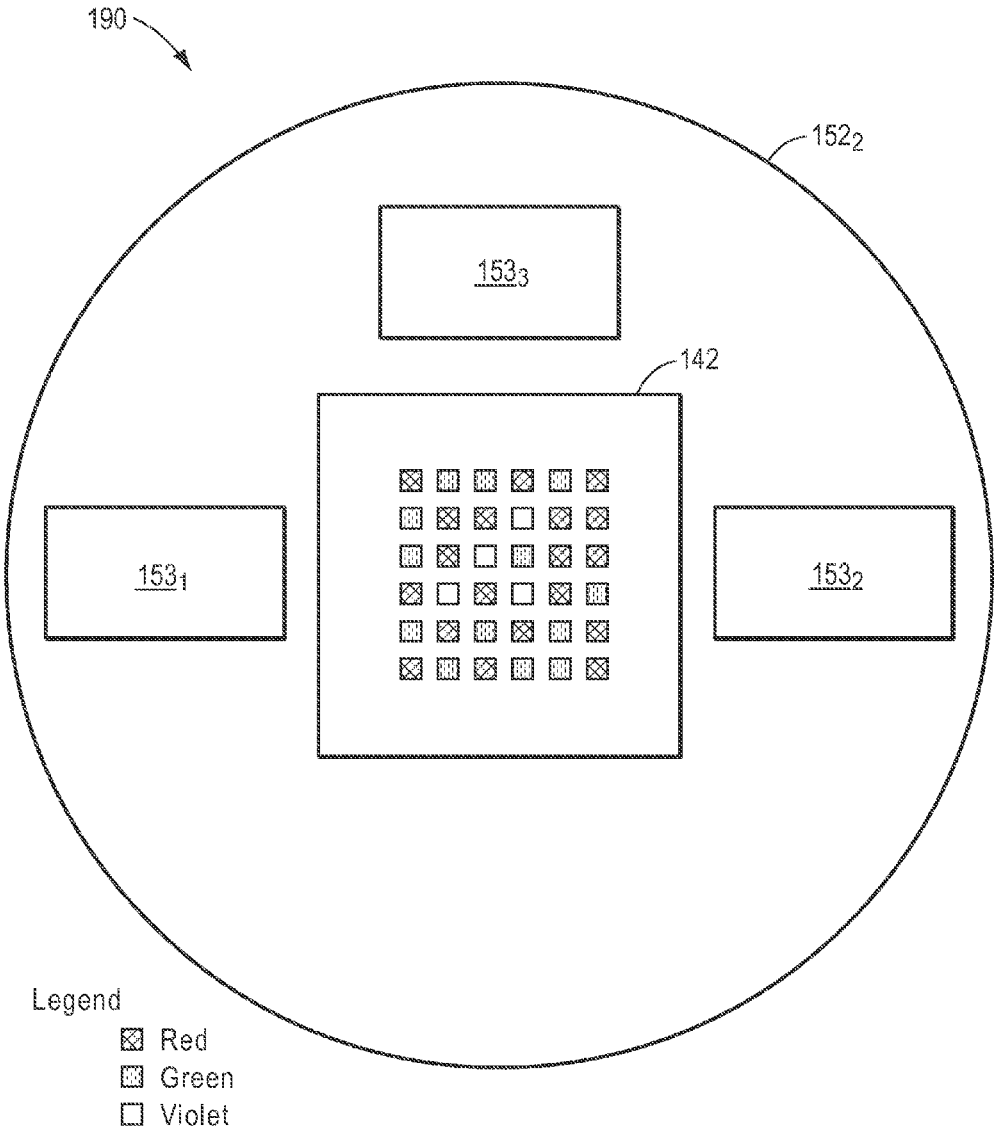
FIG. 1F is a top view illustrating a chip-array-based apparatus with phosphors disposed on a surface of a heat sink, according to an embodiment of the disclosure.

FIG. 1F is a top view 190 illustrating a light source 142 apparatus with phosphors disposed on a surface of a heat sink. As shown, wavelength converting materials $\mathbf{153}_1$, $\mathbf{153}_2$, and $\mathbf{153}_3$ are disposed atop the heat sink $\mathbf{152}_2$ in a pattern around the light source 142.

Figure 2A:
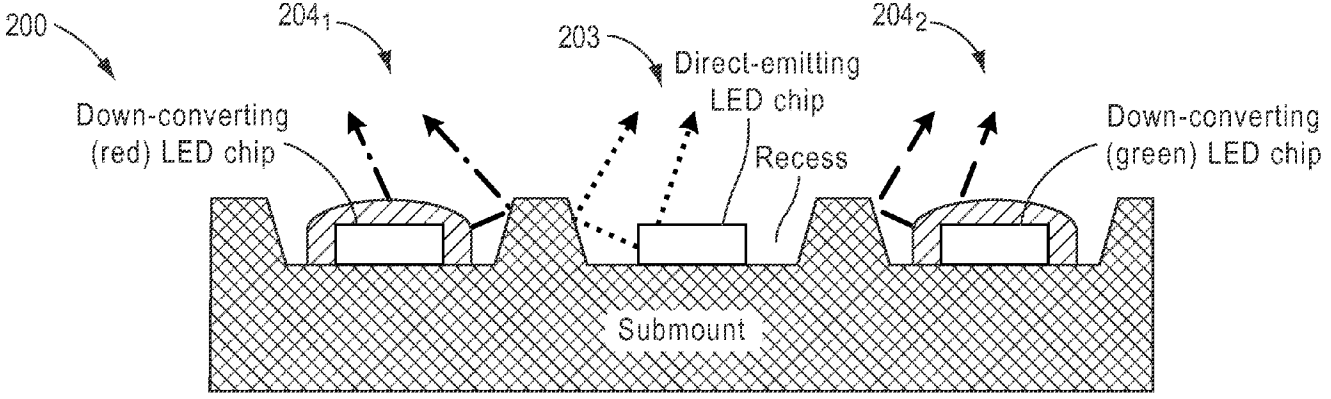
FIG. 2A is a diagram illustrating an optical device having phosphor materials disposed directly atop an LED device or in very close proximity to an LED device, according to an embodiment of the present disclosure.

FIG. 2A is a diagram illustrating an optical device 200 having phosphor materials disposed directly atop an LED device, or in very close proximity to an LED device. In embodiments wherein portions of the final white light spectrum are contributed by direct emission from radiation sources, it is desirable to avoid interaction of such direct emission with any wavelength converting materials (e.g., down-conversion materials, phosphors, wavelength-modifying layers, pixels, etc.). For example, for violet-emitting radiation sources in which the emission is being combined with other radiation sources that are pumping to longer wavelength down-conversion media (e.g., to make broader spectrum light), the down-conversion media can be isolated from the optical path of the violet-emitting LEDs. And, providing such an isolation (e.g., using an isolation barrier) increases efficiency as there are losses (e.g., backscattered light into an LED chip) associated with down-conversion. Instead, in certain embodiments, optical means (e.g., an isolation barrier) are provided to reflect light from the radiation sources toward the desired optical far-field such that the reflected light does not substantially interact with down-conversion media.

One such embodiment is shown in FIG. 2A. As shown, LEDs are placed into recessed regions in a submount (e.g., substrate or package) such that they are optically isolated from one another. Further, light from the violet direct-emitting LEDs 203 does not substantially interact with the encapsulated down-conversion media and, instead, is substantially directed into the desired final emission pattern of the entire lamp (e.g., toward the dome). Conversely, light from the down-converted LEDs (e.g., down-converting LED $\mathbf{204}_1$, down-converting LED $\mathbf{204}_2$) is converted locally and directed to the final emission pattern. In addition to providing efficient light collection from the direct-emitting LEDs, this design avoids cascading down-conversion events (e.g., violet down-converted to green, green down-converted to red) which can unnecessarily reduce overall efficiency since quantum yields of down-conversion media are less than 100%.

Light from the individual LEDs are combined together in the far field to provide a uniform broadband emission which is a combination of light from the direct-emitting and down-converting LED chips.

As can be appreciated, as shown in FIG. 2A the embodiment of optical device 200 can be used in an LED lamp comprising a first set of radiation sources configured to emit radiation characterized by a substantially violet wavelength (e.g., violet direct-emitting LEDs 203) and a second set of radiation sources configured to emit radiation characterized by a second wavelength, the second wavelength being longer than 450 nm. Further, the light emitted from violet direct-emitting LEDs 203 and the light emitted from the second set of radiation sources (e.g., down-converting LED $\mathbf{204}_1$, down-converting LED $\mathbf{204}_2$) is incident on the remote blue phosphors in or on the dome in an LED lamp, and thus a color-tuned (e.g., white) light is perceived.

The aforementioned remote blue phosphors can be phosphors (see list, below) or other wavelength-modifying materials that serve to absorb at least a portion of radiation emitted by the first set of radiation sources.

Figure 2B:
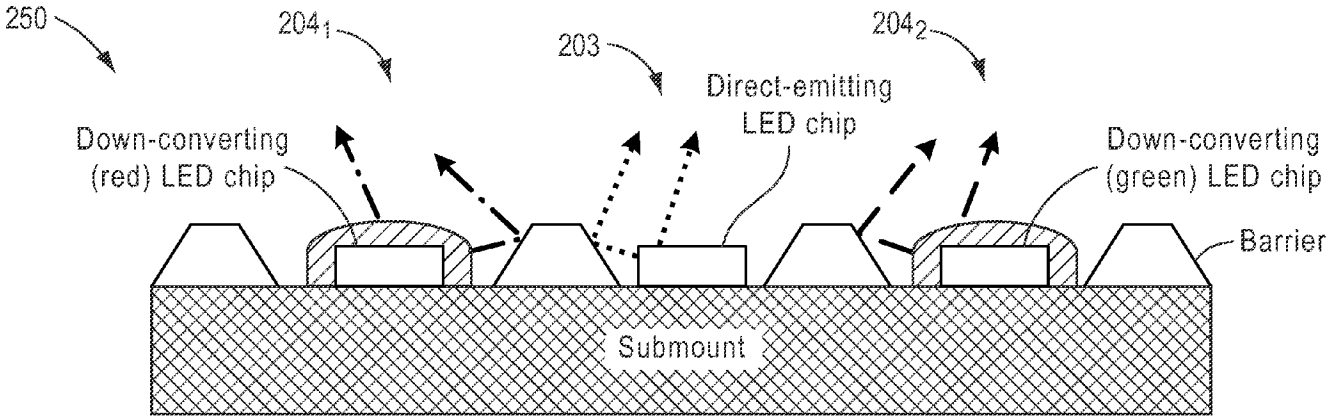
FIG. 2B is a diagram illustrating an optical device having red, green, and violet radiation sources, according to an embodiment of the present disclosure.

FIG. 2B is a diagram illustrating an optical device 250 having red, green, and violet radiation sources. In the embodiment of FIG. 2B, the same benefits pertaining to disposition of radiation sources in proximity to isolation barriers are provided by fabrication of the isolation barriers using an additive, rather than subtractive, process. In an additive processes, the barrier is formed by techniques such as overmolding, deposition/lithography/removal, attachment of a barrier mesh, etc. In subtractive processes, the recesses are formed by techniques such as deposition/lithography/removal and other techniques well known in the art. FIG. 2B shows down-converting (rec) LED chip $\mathbf{204}_1$, direct-emitting LED chip 203, down-converting (green) LED chip $\mathbf{204}_2$ overlying a submount with barriers between the chips.

The radiation sources can be implemented using various types of devices, such as light emitting diode devices or laser diode devices. In certain embodiments, the LED devices are fabricated from gallium and nitrogen submounts, such as a GaN submount. As used herein, the term GaN submount is associated with Group III nitride-based materials including GaN, InGaN, AlGaN, or other Group III containing alloys or compositions that are used as starting materials. Such starting materials include polar GaN submounts (e.g., submount 111 where the largest area surface is nominally an (h k l) plane wherein h=k=0, and l is non-zero), non-polar GaN submounts (e.g., submount material where the largest area surface is oriented at an angle ranging from about 80-100 degrees from the polar orientation described above toward an (h k l) plane wherein l=0, and at least one of h and k is non-zero), or semi-polar GaN submounts (e.g., submount material where the largest area surface is oriented at an angle ranging from about +0.1 to 80 degrees or 110-179.9 degrees from the polar orientation described above toward an (h k l) plane wherein l=0, and at least one of h and k is non-zero).

Figure 3A:
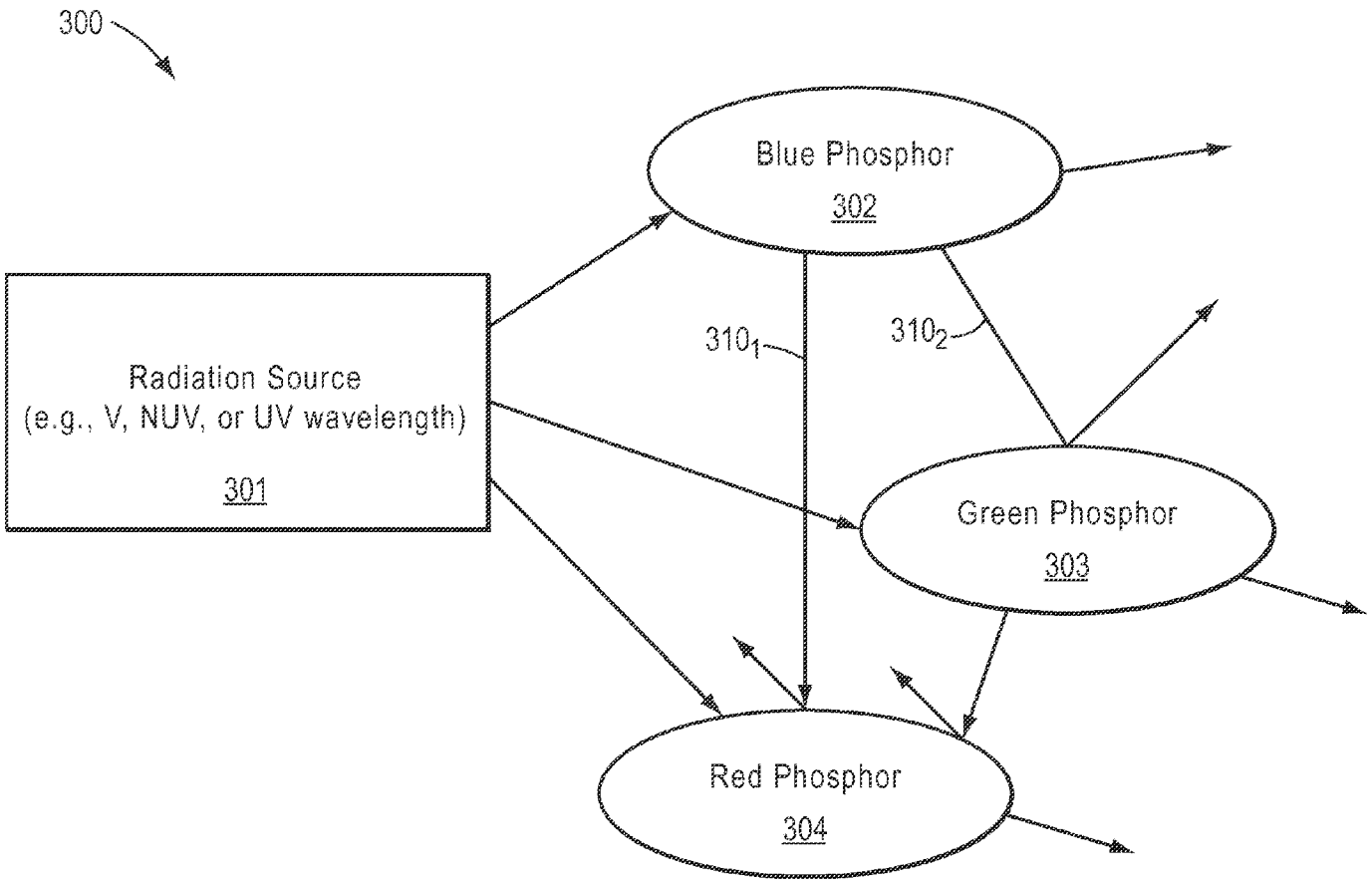
FIG. 3A is a diagram illustrating a conversion process, according to some embodiments.

FIG. 3A is a diagram illustrating a conversion process 300. As shown, a radiation source 301 is configured to emit radiation at violet, near ultraviolet, or UV wavelengths. The radiation emitted by radiation source 301 is absorbed by the phosphor materials (e.g., the blue phosphor material 302, the green phosphor material 303, and the red phosphor material 304). Upon absorbing the radiation, the blue phosphor material 302 emits blue light, the green phosphor material 303 emits green light, and the red phosphor material 304 emits red light. As shown, a portion (e.g., portion $\mathbf{310}_1$, portion $\mathbf{310}_2$) of the emissions from the blue phosphor are incident on the surrounding phosphors, and are absorbed by the green phosphor material and red phosphor material, which emits green and red light, respectively.

Figure 3B:
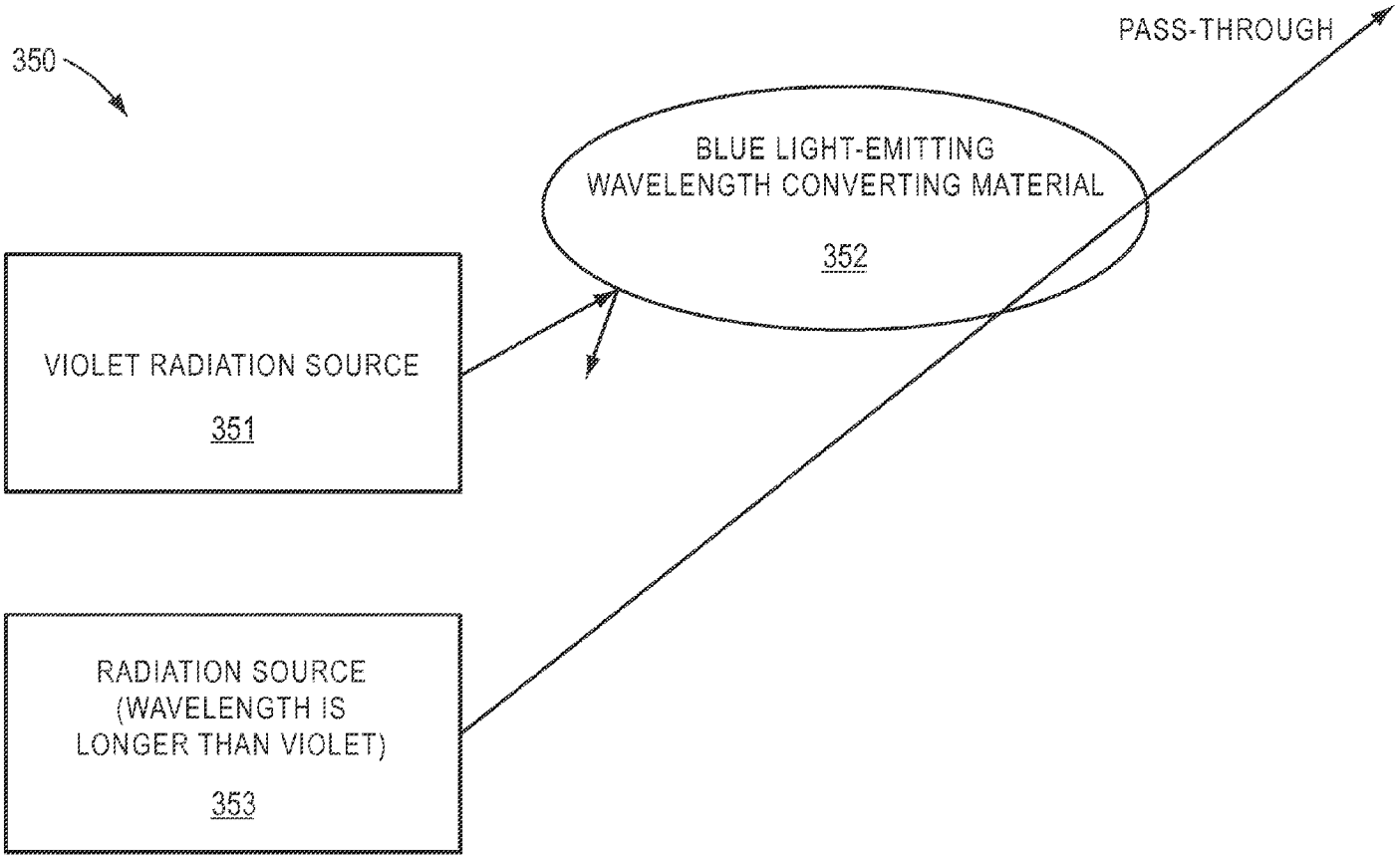
FIG. 3B is a diagram illustrating a conversion process, according to some embodiments.

FIG. 3B is a diagram illustrating a conversion process 350. As shown, a radiation source 351 is configured to emit radiation at wavelengths that are shorter than wavelengths in the blue spectrum. The radiation emitted by radiation source 351 is reflected by blue light emitting wavelength converting material 352. And, as shown, the radiation emitted by radiation source 353 (longer wavelengths) is transparent to the blue light emitting wavelength converting material 352, and the radiation emitted by radiation source 353 (longer wavelengths) passes through the blue light emitting wavelength converting material 352.

Figure 4:
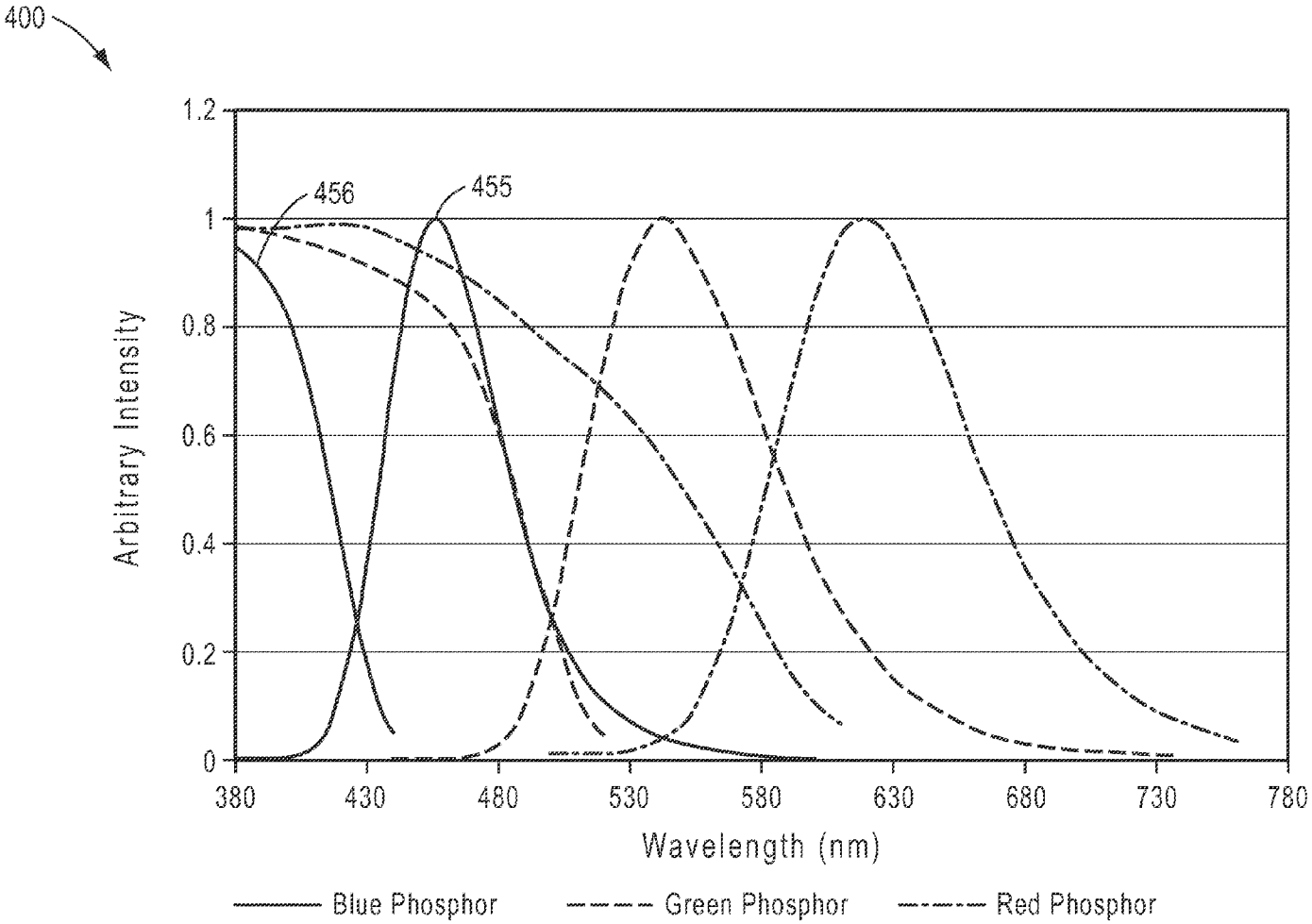
FIG. 4 is a graph illustrating a light process chart by phosphor material, according to some embodiments.

FIG. 4 is a graph illustrating a light process chart 400 by phosphor material. As shown in FIG. 4, radiation with a wavelength of violet, near violet, or ultraviolet from a radiation source is absorbed by the blue phosphor material, which in turn emits blue light. As shown in FIG. 4, each phosphor is most effective at converting radiation at its particular range of wavelength. And, as shown, some of these ranges overlap.

Moreover, as shown, the absorption curves overlap the emission curves to varying degrees. For example, the blue phosphor absorption curve 455 overlaps the blue phosphor emission curve 456 in a wavelength range substantially centered at 430 nm. In certain embodiments, some of the one or more LED devices that are disposed on a light source 142 are configured to emit substantially blue light so that the emitted blue light serves to pump red-emitting and green-emitting phosphors.

It is to be appreciated that embodiments of the present disclosure maintain the benefits of UV- and/or V-pumped pcLEDs while improving conversion efficiency. In one embodiment, an array of LED chips is provided, and is comprised of two groups. One group of LEDs has a shorter wavelength to enable pumping of a blue phosphor material. The second group of LEDs has a longer wavelength which may, or may not, excite a blue phosphor material, but will excite a green or longer wavelength (e.g., red) phosphor material. The combined effect of the two groups of LEDs in the array is to provide light of desired characteristics such as color (e.g., white) and color rendering. Furthermore, the conversion efficiency achieved in some embodiments will be higher than that of the conventional approach. In particular, the cascading loss of blue photons pumping longer-wavelength phosphors may be reduced by localizing blue phosphor to regions near the short-wavelength LEDs. In addition, the longer-wavelength pump LEDs will contribute to overall higher efficacy by being less susceptible to optical loss mechanisms in GaN, metallization, and packaging materials, as described above.

In certain embodiments, a relatively larger number of LED devices that emit wavelengths longer than blue are combined with a relatively smaller number of LED devices that emit wavelengths shorter than blue, and the combination of those radiation sources with a blue-emitting phosphor combine to produce white light.

Any of the wavelength conversion materials discussed herein can be ceramic or semiconductor particle phosphors, ceramic or semiconductor plate phosphors, organic or inorganic downconverters, upconverters (anti-stokes), nanoparticles, and other materials which provide wavelength conversion. Some examples are listed as follows:

$(Sr_n,Ca_{1-n})_{10}(PO_4)_6*B_2O_3:Eu^{2+}$ (wherein $0\leq n\leq 1$)
$(Ba,Sr,Ca)_5(PO_4)_3(Cl,F,Br,OH):Eu^{2+},Mn^{2+}$
$(Ba,Sr,Ca)BPO_5:Eu^{2+},Mn^{2+}$
$Sr_2Si_3O_8*2SrCl_2:Eu^{2+}$
$(Ca,Sr,Ba)_3MgSi_2O_8:Eu^{2+}, Mn^{2+}$
$BaAl_8O_{13}:Eu^{2+}$
$2SrO*0.84P_2O_5*0.16B_2O_3:Eu^{2+}$
$(Ba,Sr,Ca)MgAl_{10}O_{17}:Eu^{2+},Mn^{2+}$
$K_2SiF_6:Mn^{4+}$
$(Ba,Sr,Ca)Al_2O_4:Eu^{2+}$
$(Y,Gd,Lu,Sc,La)BO_3:Ce^{3+},Tb^{3+}$
$(Ba,Sr,Ca)_2(Mg,Zn)Si_2O_7:Eu^{2+}$
$(Mg,Ca,Sr,Ba,Zn)_2Si_{1-x}O_{4-2x}:Eu^{2+}$ (wherein $0\leq x\leq 0.2$)
$CaMgSi_2O_6:Eu^{2+}$
$(Ca,Sr,Ba)MgSi_2O_6:Eu^{2+}$
$(Sr,Ca,Ba)(Al,Ga)_2S_4:Eu^{2+}$
$(Ca,Sr)_8(Mg,Zn)(SiO_4)_4Cl_2:Eu^{2+},Mn^{2+}$
$Na_2Gd_2B_2O_7:Ce^{3+},Tb^{3+}$
$(Sr,Ca,Ba,Mg,Zn)_2P_2O_7:Eu^{2+},Mn^{2+}$
$(Gd,Y,Lu,La)_2O_3:Eu^{3+},Bi^{3+}$
$(Gd,Y,Lu,La)_2O_2S:Eu^{3+},Bi^{3+}$
$(Gd,Y,Lu,La)VO_4:Eu^{3+},Bi^{3+}$
$(Ca,Sr)S:Eu^{2+},Ce^{3+}$
$(Y,Gd,Tb,La,Sm,Pr,Lu)_3(Sc,Al,Ga)_{5-n}O_{12-3/2n}:Ce^{3+}$ (wherein $0\leq n\leq 0.5$)
$ZnS:Cu+,Cl^-$
$(Y,Lu,Th)_3Al_5O_{12}:Ce^{3+}$
$ZnS:Cu^+,Al^{3+}$
$ZnS:Ag^+,Al^{3+}$
$ZnS:Ag^+,Cl^-$
(Ca, Sr) $Ga_2S_4:Eu^{2+}$
$SrY_2S_4:Eu^{2+}$
$CaLa_2S_4:Ce^{3+}$
$(Ba,Sr,Ca)MgP_2O_7:Eu^{2+},Mn^{2+}$
$(Y,Lu)_2WO_6:Eu^{3+},Mo^{6+}$
$CaWO_4$
$(Y,Gd,La)_2O_2S:Eu^{3+}$
$(Y,Gd,La)_2O_3:Eu^{3+}$
$(Ba,Sr,Ca)_nSi_nN_n:Eu^{2+}$ (where 2n+4=3n)
$Ca_3(SiO_4)Cl_2:Eu^{2+}$
$(Y,Lu,Gd)_{2-n}Ca_nSi_4N_{6+n}C_{1-n}:Ce^{3+}$, (wherein $0\leq n\leq 0.5$)
(Lu,Ca,Li,Mg,Y) α-SiAlON doped with $Eu^{2+}$ and/or $Ce^{3+}$
$(Ca,Sr,Ba)SiO_2N_2:Eu^{2+},Ce^{3+}$
$(Sr,Ca)AlSiN_3:Eu^{2+}$
$CaAlSi(ON)_3:Eu^{2+}$
$Sr_{10}(PO_4)_6Cl_2:Eu^{2+}$
$(BaSi)O_{12}N_2:Eu^{2+}$
$M(II)_aSi_bO_cN_dCe:A$ wherein ($6<a<8, 8<b<14, 13<c<17, 5<d<9, 0<e<2$) and M(II) is a divalent cation of (Be,Mg,Ca, Sr,Ba,Cu,Co,Ni,Pd,Tm,Cd) and A of (Ce,Pr,Nd,Sm,Eu,Gd, Tb,Dy, Ho,Er,Tm,Yb,Lu,Mn,Bi,Sb)
$SrSi_2(O,Cl)_2N_2:Eu^{2+}$
$(Ba,Sr)Si_2(O,Cl)_2N_2:Eu^{2+}$
$LiM_2O_8:Eu^{3+}$ where M=(W or Mo)

For purposes of the application, it is understood that when a phosphor has two or more dopant ions (i.e., those ions following the colon in the above phosphors), this is to mean that the phosphor has at least one (but not necessarily all) of those dopant ions within the material. That is, as understood by those skilled in the art, this type of notation means that the phosphor can include any or all of those specified ions as dopants in the formulation. Further, it is to be understood that nanoparticles, quantum dots, semiconductor particles, and other types of materials can be used as wavelength converting materials.

Figure 5:
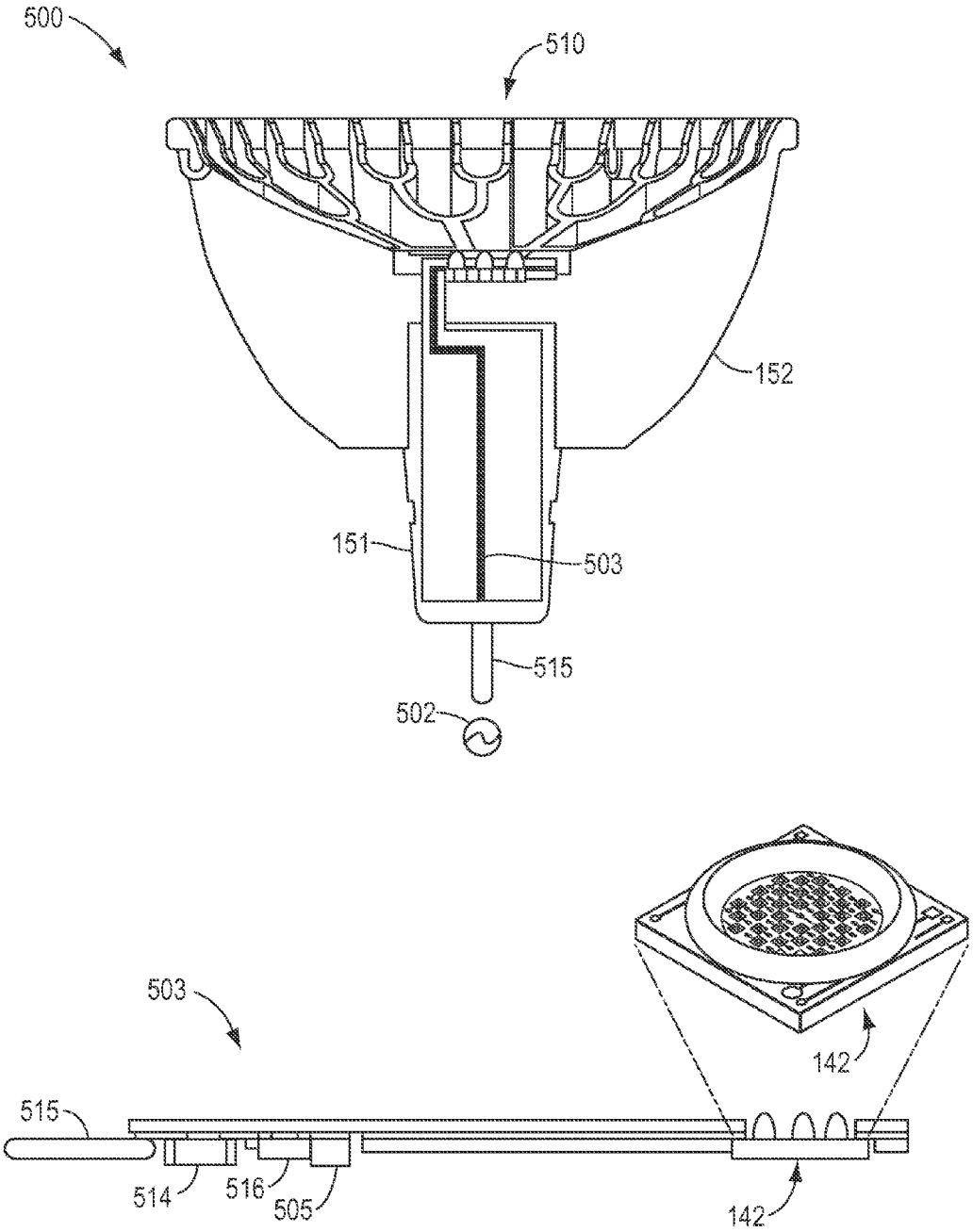
FIG. 5 is an illustration of an LED lamp comprising light source, according to an embodiment of the present disclosure.

FIG. 5 is an illustration of an LED system 500 comprising an LED lamp 510, according to some embodiments. The LED lamp 510 is configured such that the total emission color characteristic of the LED lamp is substantially white in color.

The LED system 500 is powered by an AC power source 502, to provide power to a rectifier module 516 (e.g., a bridge rectifier) which in turn is configured to provide a rectified output to an array of radiation emitting devices (e.g., a first array of radiation emitting devices, a second array of radiation emitting devices) comprising a light source 142. A control module 505 is electrically coupled to the first array and second array of radiation emitting devices; and a signal compensating module 514 electrically coupled to the control module 505, the signal compensating module being configured to generate compensation factors based on the signaling of the control module. As shown, the rectifier module 516 and the signal compensating module (and other components) are mounted to a printed circuit board 503. Further, and as shown, the printed circuit board 503 is electrically connected to a power pin 515 mounted within a base member 151, and the base is mechanically coupled to a heat sink 152.

The embodiments disclosed herein can be operated using alternating current that is converted to direct current (as in the foregoing paragraphs), or can be used using alternating current without conversion. Some embodiments deliver DC to power pin 515.

Figure 6:
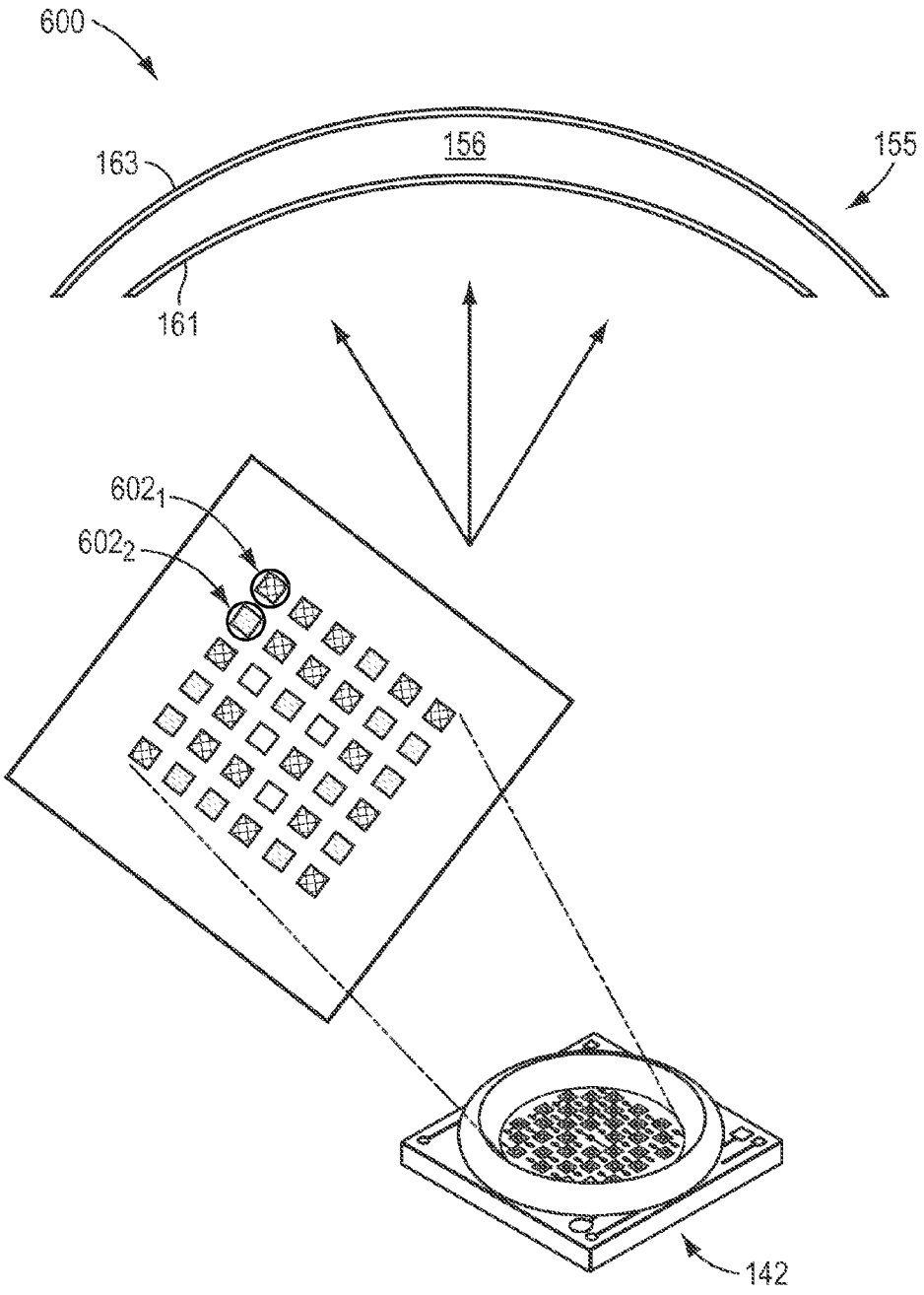
FIG. 6 is a diagram illustrating an optical device embodied as a light source constructed using an array of LEDs in proximity to remote down-converting member having a phosphor mix, according to an embodiment of the disclosure.

FIG. 6 is a diagram illustrating an optical device embodied as a light source constructed using an array of LEDs in proximity to remote down-converting member having a phosphor mix, according to certain embodiments of the disclosure.

As shown, the embodiment of FIG. 6 depicts an LED lamp comprising a light source 142, which light source is formed of an array having a first plurality of "n" of radiation sources configured to emit radiation characterized by a first wavelength, the first wavelength being substantially violet, and a second plurality of "m" of radiation sources configured to emit radiation characterized by a second wavelength, the second wavelength being substantially violet. The remote structural member 155 serves to support a wavelength converting layer configured to absorb at least a portion of radiation emitted by the first plurality of radiation sources, where the wavelength converting layer has a wavelength emission ranging from about 420 nm to about 520 nm. As shown in FIG. 6, remote structural member 155 includes remote structural member outer surface 163, volume 156, and remote structural member inner surface 161.

In some embodiments, the wavelength converting layer comprises one or more of the following:

$(Ca, Sr, Ba)MgSi_2O_6:Eu^{2+}$ $Ba_3MgSi_2O_8:Eu^{2+}$ $Sr_{10}(PO_4)_6C_{12}:Eu^{2+}$

In certain embodiments, LED lamp comprises "n" radiation sources configured to emit radiation characterized by a range of about 380 nm to about 435 nm. Further, certain embodiments are configured such that the wavelength converting layer comprises blue-emitting down-converting materials disposed in or on the remote structural member (as shown, the remote structural member forms a dome).

Figure 7:
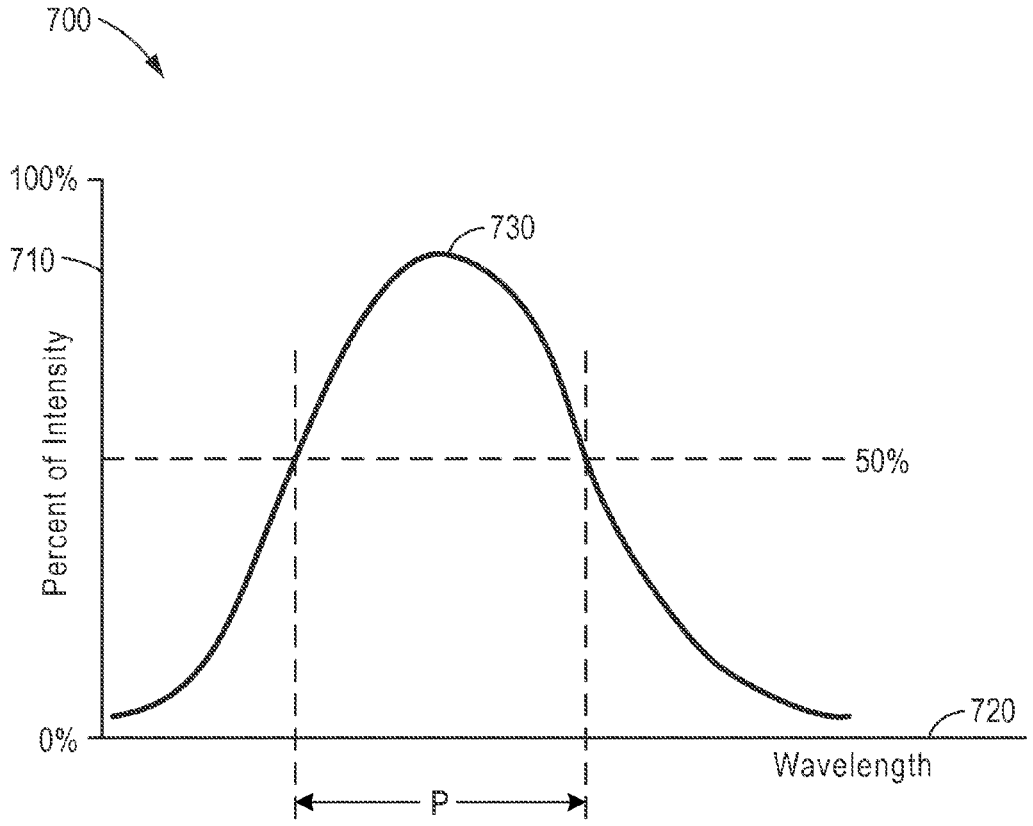
FIG. 7 is a diagram showing relative absorption strengths, according to an embodiment of the disclosure.

The light source 142 can comprise radiation source encapsulating material (e.g., encapsulating material $\mathbf{602}_1$, encapsulating material $\mathbf{602}_2$) that overlays at least some of the first plurality of radiation sources and possibly the second plurality of radiation sources, where the encapsulating material comprises silicone and/or epoxy material, and where at least some of the down-converting material serves to absorb radiation emitted by the second plurality of radiation sources. Of course, the number "m" and the number "n" can be varied such that a ratio (m:n) describes the relative mix of the radiation sources. For example, the ratio of the number m to the number n (m:n) can be greater than the ratio 2:1. Or, strictly for example, the ratio of the number m to the number n (m:n) is about 3:1. In various configurations as depicted in FIG. 7, the total emission color characteristic of the LED lamp is substantially white in color.

In certain embodiments, the wavelength converting layer as is distributed upon or within the volume and has a relative absorption strength of less than 50% of a peak absorption strength of the first wavelength converting layer when measured against the wavelength emitted by the second plurality of radiation sources.

Other configurations are reasonable and envisioned. For example:

- configurations where the down-converting material emits radiation with a wavelength longer than about 460 nm and shorter than about 600 nm.
- configurations where down-converting material disposed on the m radiation sources emits radiation with a wavelength longer than about 550 nm and shorter than about 750 nm.
- configurations where the m radiation sources consist of k and l sources such that k+l=m, and the k sources have an encapsulating material
- configurations where an additional down-converting material is disposed in or on the remote structural member (e.g., other than blue-emitting down-converting material).

In certain configurations down-converting material is disposed on a portion of the lamp such that the radiation from either the m or n radiation sources is not absorbed without first undergoing either an optical scattering or optical reflection. It is also possible that the down-converting material (e.g., the additional down-converting material) is substantially excited by the first down-converting material disposed on the remote structural member.

Even still more light process can occur within the practice of the embodiments, namely, processes where the additional down converting materials have a peak emission wavelength ranging from about 580 nm to about 680 nm. And/or where the down-converting material has an emission full-width at half maximum spectra less than about 80 nm, and/or where the down-converting material has an emission full-width at half maximum spectra less than about 60 nm, or less than about 40 nm.

The down-converting material can comprise down-converting material in the form of a quantum dot material.

Other configurations of the LED lamp are possible including embodiments where a first plurality of n of radiation sources are configured to emit radiation characterized as being substantially blue; and a second plurality of m of radiation sources are configured to emit radiation characterized as being substantially violet, and further, where a first wavelength converting layer is configured to absorb at least a portion of radiation emitted by the second plurality of radiation sources, while the first wavelength converting layer has a wavelength emission ranging from about 500 nm to about 750 nm.

FIG. 7 is a diagram 700 showing a relative absorption strength based on measured intensity (e.g., intensity ordinate 710) as a function of wavelength (e.g., wavelength abscissa 720) for a particular spectrum range of light. A relative absorption strength of 50% of a peak absorption strength is shown as covering a range of wavelengths ("P", as shown) centered about a given peak wavelength (e.g., peak 730).

Figure 8:
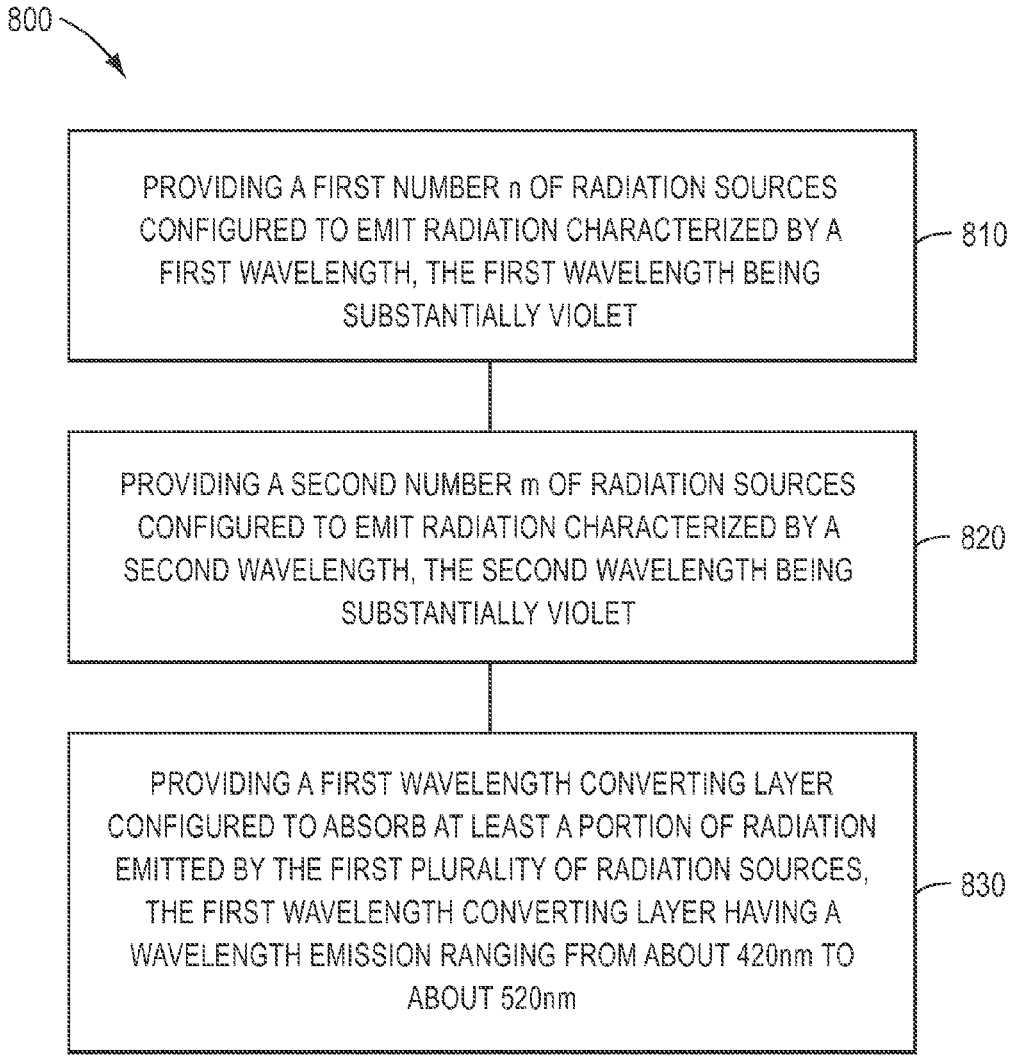
FIG. 8 depicts a block diagram of a system to perform certain functions for manufacturing an LED lamp, according to an embodiment of the disclosure.

FIG. 8 depicts a block diagram of a system to perform certain functions for manufacturing an LED lamp. As an option, the present system 800 may be implemented in the context of the architecture and functionality of the embodiments described herein. Of course, however, the system 800 or any operation therein may be carried out in any desired environment. The modules of the system can, individually or in combination, perform manufacturing method steps within system 800. Any method steps performed within system 800 may be performed in any order unless as may be specified in the claims. As shown, FIG. 8 implements a process for manufacturing an LED lamp comprising: providing a first plurality of n of radiation sources configured to emit radiation characterized by a first wavelength, the first wavelength being substantially violet (see step 810), providing a second plurality of m of radiation sources configured to emit radiation characterized by a second wavelength, the second wavelength being substantially violet (see step 820), and providing a first wavelength converting layer configured to absorb at least a portion of radiation emitted by the first plurality of radiation sources, the first wavelength converting layer having a wavelength emission ranging from about 420 nm to about 520 nm (see step 830).

Figure 9A:
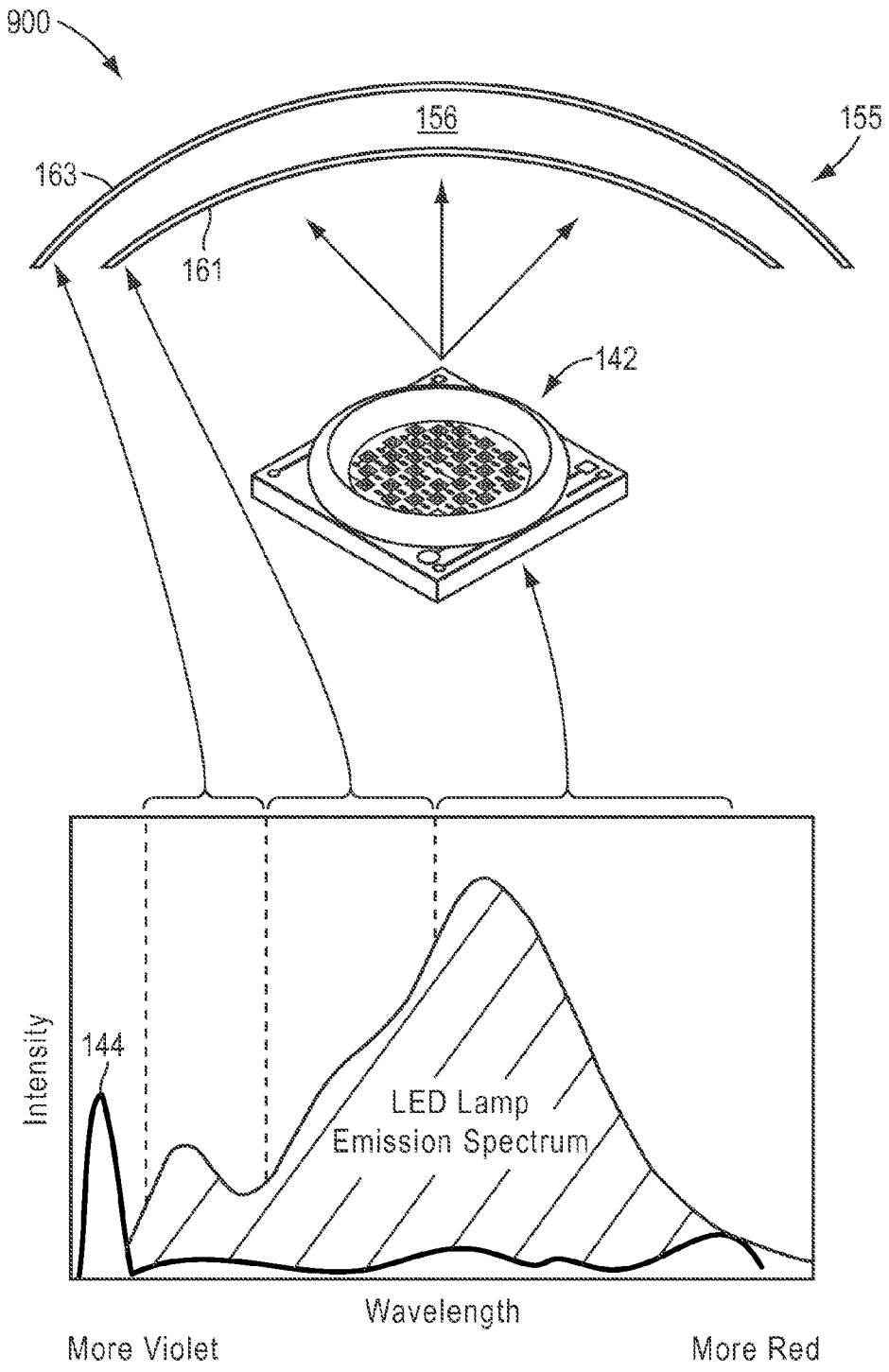
FIG. 9A depicts a system to perform certain functions of an LED lamp, according to an embodiment of the disclosure.

FIG. 9A depicts a system 900 to perform certain functions of an LED lamp. As an option, the present system 900 may be implemented in the context of the architecture and functionality of the embodiments described herein. Of course, however, the system 900 or any operation therein may be carried out in any desired environment.

Figure 9B:
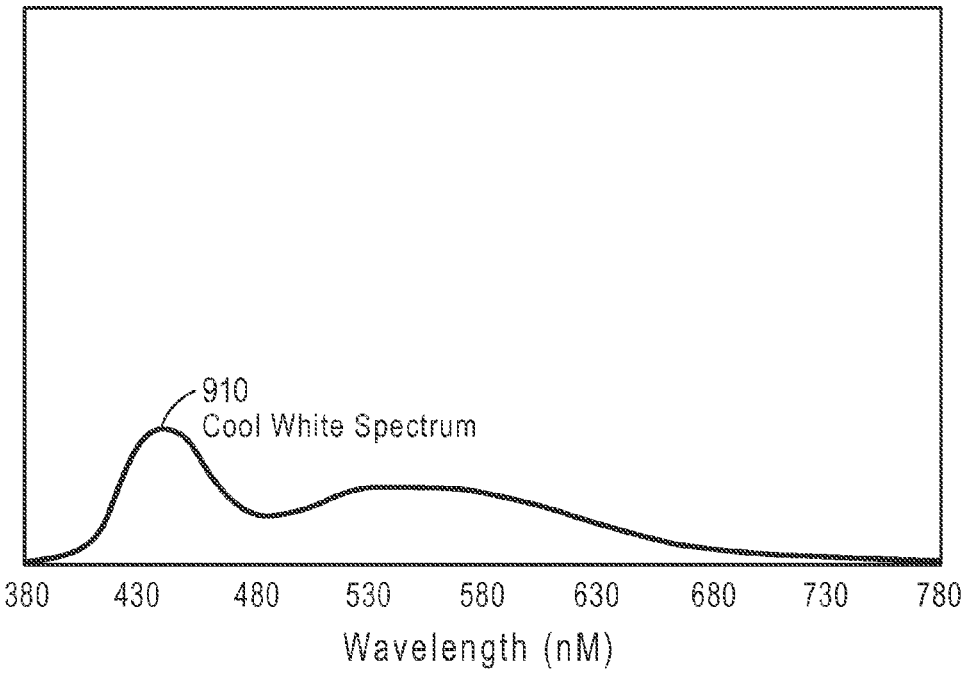
FIG. 9B depicts a spectrum of a light process in ambient light, according to an embodiment of the disclosure.

As shown in FIG. 9A, blue-emitting down-converting materials are disposed on the remote structural member outer surface 163 or within the volume 156 of the remote structural member forming a dome. And, as shown, yellow-emitting wavelength-converting materials are disposed on a remote structural member inner surface 161. Accordingly, the appearance of the dome as viewed in natural light (e.g., sunlight) would be substantially white or cool white. The wavelength converting processes for producing substantially white or cool white color under ambient light conditions are depicted as cool white spectrum 910 in FIG. 9B, according to certain embodiments.

In operation (e.g., when the light source is on), the light source 142 produces incident light from active LEDs (see light source emission spectrum 144), a first portion of the LED emission spectrum incident light is down-converted by the blue-emitting down-converting materials disposed in or on the dome, and a second portion of the incident light is down-converted by yellow-emitting wavelength-converting materials disposed the remote structural member inner surface 161. The combination of the emitted light from the light source 142 and emitted light from the down-converting materials combines to produce a white-appearing light (e.g., the warm white spectrum 920 of FIG. 9C, or the LED lamp emission spectrum, as shown in FIG. 9D).

As disclosed herein, the combination of the colors of the light emissions from the radiations sources and from the wavelength-converting materials produce white-appearing light when the LED lamp is in operation. And, the combination of yellow-emitting and/or green-emitting down-converting materials with blue-emitting down-converting materials on the remote structural member results in an aggregate color tuning that contributes to a white-appearing shade when the LED lamp is not in operation. The whiteness can be tuned by selecting the types and proportions of the yellow-emitting and/or green-emitting down-converting materials with respect to the blue-emitting down-converting materials, and/or with respect to other wavelength-converting materials, including red-emitting down-converting materials.

Figure 9C:
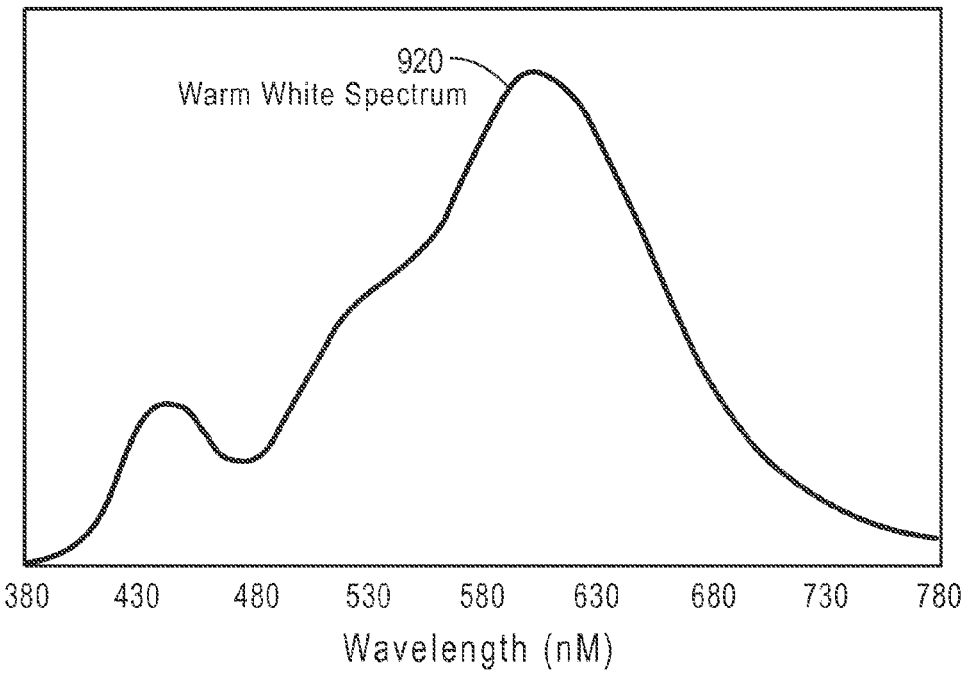
FIG. 9C depicts a spectrum of a light process, according to an embodiment of the disclosure.

For example, an LED lamp can be configured such that a first amount p of first wavelength converting material is selected and a second amount q of second wavelength converting material is selected such that the total amount and ratio (first amount p:second amount q) are sufficient to provide a white shade under natural light. Moreover, the same amount and ratio (first amount p:second amount q) serves to provide an LED lamp emission that has a warm white emission spectrum when combined with the LED source emission internal to the lamp (e.g., emissions from the light source 142). The warm white emission spectrum is exemplified in the warm white spectrum 920 as shown in FIG. 9C.

Figure 9D:
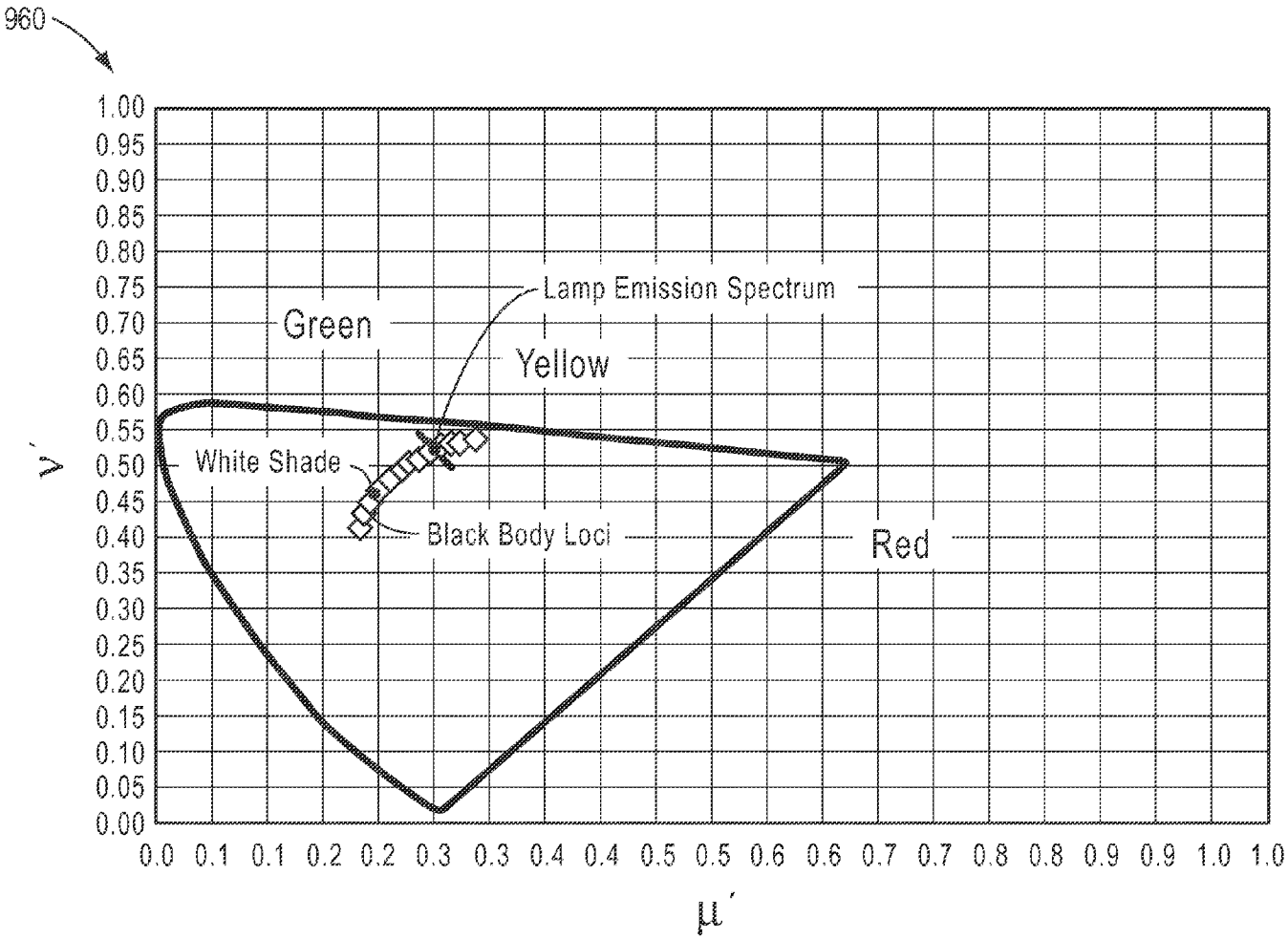
FIG. 9D depicts a chromaticity chart, according to embodiments of the disclosure.

FIG. 9D depicts a chromaticity chart 960. The figure depicts black body loci (also called Planckian loci), which black body loci represent colors (as shown) through a range from deep red through orange, yellowish white, warm white, white, and cool white.

At least some of a range of shades throughout the black body loci are tunable by the relative measures of colors (e.g., red, green/yellow, blue). In the disclosed embodiments of LED lamps, color tuning to achieve a particular (e.g., desired) white shade of the LED lamp under conditions of ambient lighting can be accomplished by selecting the relative amounts of wavelength-emitting materials. Similarly, when those relative amounts of wavelength-emitting materials are excited by the light source 142, the aggregate LED lamp emission corresponds to a particular (e.g., desired) white light color, such as depicted by the warm white lamp emission spectrum (as shown).

As one specific example, an LED lamp can be configured to achieve a particular white shade by selecting a first amount p of first wavelength converting material (e.g., a blue phosphor) and selecting a second amount q of second wavelength converting material (e.g., a yellow phosphor). In certain cases, a third wavelength converting material (e.g., a red phosphor) can be mixed in to achieve the desired tunable white shade. The amounts p and q are selected to achieve (1) the desired (e.g., cool white) shade of the LED lamp under ambient light conditions, and (2) the desired LED lamp emission spectrum when the LED lamp is in operation (e.g., when the light source is on and its emission is combined with the remote phosphor emission).

In certain embodiments, various pattern and/or arrangement for different radiation sources can be used. The above description and illustrations should not be taken as limiting the scope of the present disclosure which is defined by the appended claims.

What is claimed is:

1. An LED lamp comprising:

a first plurality of n radiation sources configured to emit radiation characterized by a first wavelength, the first wavelength being substantially violet;

a second plurality of m radiation sources configured to emit radiation characterized by a second wavelength, the second wavelength being substantially violet; and a first wavelength converting layer configured to absorb at least a portion of the radiation emitted by the first plurality of radiation sources, the first wavelength converting layer having an emission wavelength ranging from about 420 nm to about 520 nm.

2. The LED lamp of claim 1, wherein the first wavelength is in a first range from about 380 nm to about 435 nm.

3. The LED lamp of claim 1, wherein first wavelength converting layer comprises blue-emitting down-converting materials disposed in or on a remote structural member, the remote structural member forming a dome.

4. The LED lamp of claim 1, further comprising an encapsulating material overlaying the first plurality of radiation sources and the second plurality of radiation sources, the encapsulating material comprising a material selected from silicone, epoxy, and a combination thereof.

5. The LED lamp of claim 1, wherein the first plurality of radiation sources and the second plurality of radiation sources comprises a light emitting diode.

6. The LED lamp of claim 1, wherein a ratio of m to n (m:n) is greater than 2:1.

7. The LED lamp of claim 1, wherein a total emission color characteristic of the LED lamp is substantially a white color.

8. The LED lamp of claim 1, wherein a ratio of m to n (m:n) is about 3:1.

9. The LED lamp of claim 1, further comprising a rectifier module.

10. The LED lamp of claim 1, further comprising a base.

11. The LED lamp of claim 1, wherein the first wavelength converting layer is characterized by a relative absorption strength of less than 50% of a peak absorption strength of the first wavelength converting layer at the wavelength emitted by the second plurality of radiation sources.

12. The LED lamp of claim 1, wherein the second plurality of radiation sources is configured with an encapsulating material comprising at least one down-converting material configured to absorb at least a portion of the radiation emitted by the second plurality of radiation sources.

13. The LED lamp of claim 12, wherein the at least one down-converting material emits radiation with a wavelength longer than about 460 nm and shorter than about 600 nm.

14. The LED lamp of claim 12, wherein the at least one down-converting material emits radiation with a wavelength longer than about 550 nm and shorter than about 750 nm.

15. The LED lamp of claim 12, wherein the second plurality of radiation sources comprise k+l sources, wherein k+l=m; and the k sources comprise an encapsulating material comprising the at least one down-converting material that emits radiation with a wavelength longer than about 460 nm and shorter than about 600 nm.

16. The LED lamp of claim 12, wherein the second plurality of radiation sources comprise k+l sources, wherein k+l=m, and the 1 sources comprise an encapsulating material comprising at least one down-converting material that emits radiation with a wavelength longer than about 550 nm and shorter than about 750 nm.

17. The LED lamp of claim 12, comprising a second down-converting material disposed on a remote structural member.

18. The LED lamp of claim 12, comprising a second down-converting material disposed on a portion of the lamp such that the radiation from one of the first radiation sources and the second radiation source is not absorbed without first undergoing either an optical scattering or optical reflection.

19. An LED lamp comprising:

a first plurality of n radiation sources configured to emit radiation characterized by a first wavelength, the first wavelength being substantially blue; and a second plurality of m radiation sources configured to emit radiation characterized by a second wavelength, the second wavelength being substantially violet; and a first wavelength converting layer configured to absorb at least a portion of radiation emitted by the second plurality of radiation sources, the first wavelength converting layer having an emission wavelength ranging from about 500 nm to about 750 nm.

20. The LED lamp of claim 19, wherein the first wavelength converting layer comprises down-converting materials disposed in or on a remote structural member, the remote structural member forming a dome.

21. An LED lamp with an outer surface having a white appearance under ambient light, comprising:

a light source;

an outer surface, the outer surface positioned to form a remote structural member;

a first wavelength converting layer disposed on the remote structural member, the first wavelength converting layer configured to absorb at least a portion of radiation emitted by the light source, the first wavelength converting layer having an emission wavelength ranging from about 420 nm to about 520 nm; and a second wavelength converting layer disposed on the remote structural member, the second wavelength converting layer having an emission wavelength ranging from about 490 nm to about 630 nm.

22. The LED lamp of claim 21, wherein a first amount p of the first wavelength converting material and a second amount q of the second wavelength converting material are selected in a ratio p:q to provide a white appearance under ambient light.

* * * * *